US006721533B2

(12) United States Patent
Sato et al.

(10) Patent No.: US 6,721,533 B2
(45) Date of Patent: Apr. 13, 2004

(54) TONER CLEANING DEVICE, IMAGE FORMING METHOD USING THE DEVICE, AND IMAGE FORMING APPARATUS USING THE DEVICE

(75) Inventors: Kazuhiko Sato, Saitama (JP); Satoshi Uchino, Tokyo (JP); Fumitaka Mochizuki, Tokyo (JP); Isao Endo, Hamagawa (JP)

(73) Assignee: Konica Corporation, Tokyo (JP)

( * ) Notice: Subject to any disclaimer, the term of this patent is extended or adjusted under 35 U.S.C. 154(b) by 104 days.

(21) Appl. No.: 10/027,506

(22) Filed: Dec. 20, 2001

(65) Prior Publication Data

US 2002/0127036 A1 Sep. 12, 2002

(30) Foreign Application Priority Data

Dec. 25, 2000 (JP) ..... 2000-392503
Jan. 18, 2001 (JP) ..... 2001-010145

(51) Int. Cl.[7] ..... G03G 21/00
(52) U.S. Cl. ..... 399/350; 399/351
(58) Field of Search ..... 399/350, 351

(56) References Cited

U.S. PATENT DOCUMENTS 3,927,936 A * 12/1975 Komori et al. ..... 399/351 X
4,152,067 A * 5/1979 Kubota ..... 399/351
4,334,766 A * 6/1982 Sugiyama et al. ..... 399/351
4,498,760 A * 2/1985 Sugiyama ..... 399/351
6,456,820 B1 * 9/2002 Sato et al. ..... 399/350
6,463,253 B2 * 10/2002 Sato ..... 399/350

FOREIGN PATENT DOCUMENTS

| | | | |
|---|---|---|---|
| JP | 53-82419 | * | 7/1978 |
| JP | 58-149085 | * | 9/1983 |
| JP | 1-113782 | * | 5/1989 |
| JP | 1-113783 | * | 5/1989 |
| JP | 1-179071 | * | 7/1989 |
| JP | 2-132483 | * | 5/1990 |
| JP | 2-149878 | * | 6/1990 |
| JP | 9-106231 | * | 4/1997 |

* cited by examiner

*Primary Examiner*—Fred L. Braun
(74) *Attorney, Agent, or Firm*—Squire, Sanders & Dempsey L.L.P.

(57) ABSTRACT

A toner cleaning device for removing toner which remains on an organic photoreceptor is provided. The toner cleaning device can include a cleaning blade, a support member of the cleaning blade and a damping material. An image forming method is also provided. The method includes removing toner which remains on an organic photoreceptor by using the toner cleaning device.

10 Claims, 15 Drawing Sheets

FIG. 16 ( a )
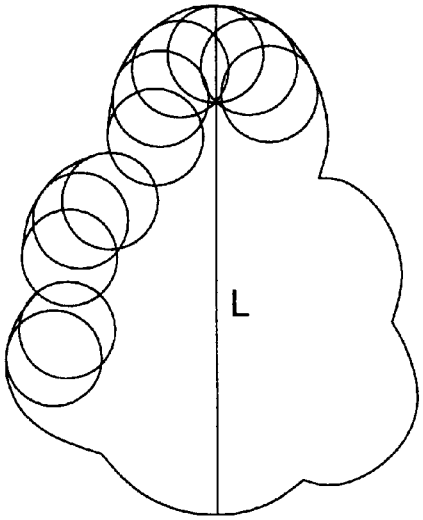
FIG. 16 ( b )
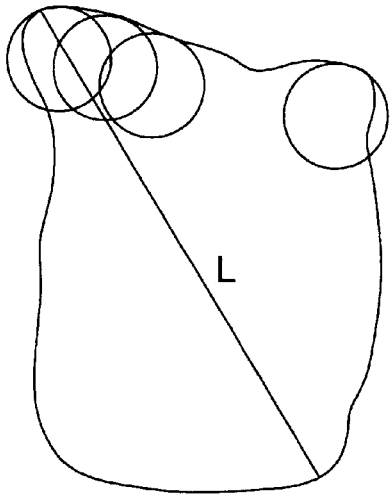
FIG. 16 ( c )
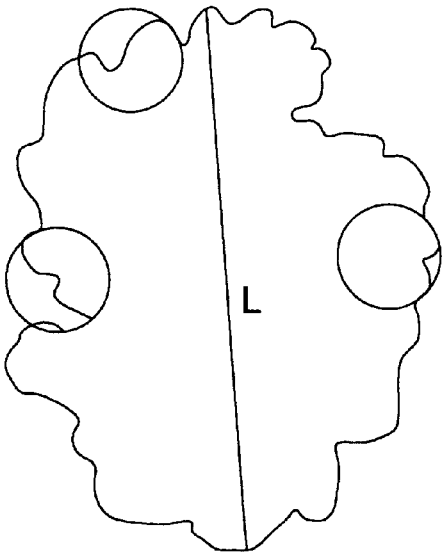

FIG. 20 ( a )
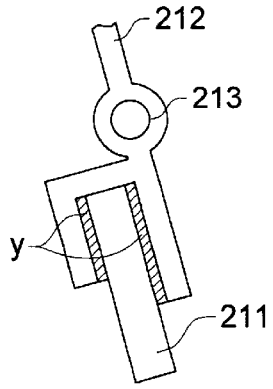
FIG. 20 ( b )
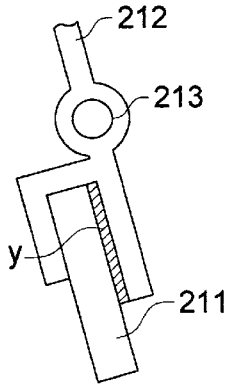
FIG. 20 ( c )
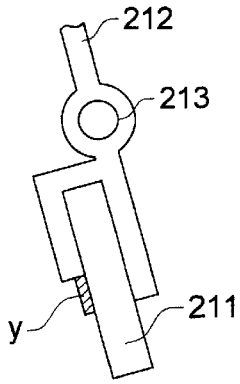
FIG. 20 ( d )
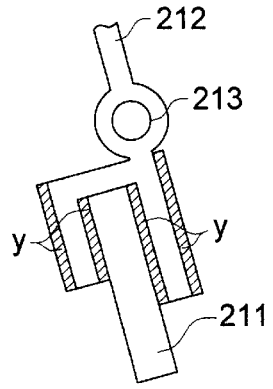
FIG. 20 ( e )
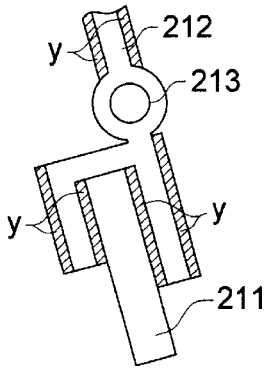
FIG. 20 ( f )
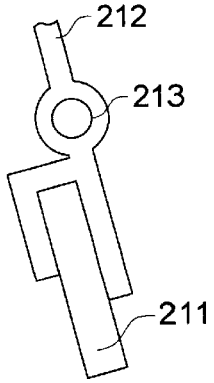
FIG. 20 ( g )
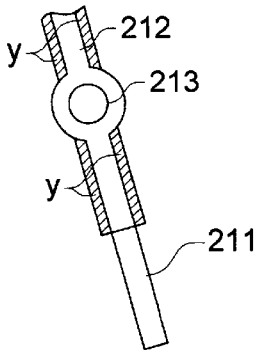

TONER CLEANING DEVICE, IMAGE FORMING METHOD USING THE DEVICE, AND IMAGE FORMING APPARATUS USING THE DEVICE

BACKGROUND OF THE INVENTION

The present invention relates to a toner cleaning device employed in electrophotographic copiers and printers, an image forming method using the toner cleaning device, and an image forming apparatus using the toner cleaning device.

In recent years, as image holding bodies, employed in electrophotographic image forming apparatus, organic photoreceptors (hereinafter referred simply to as photoreceptors) comprising organic photoconductive materials have been most widely employed. Organic photoreceptors are superior to other photoreceptors since it is easier to develop materials in response to various types of exposure light sources ranging from visible light to infrared light; it is possible to select materials which result in no environmental pollution; the production cost is lower; and the like. However, organic photoreceptors are mechanically weak. Due to that, problems occur in which, during copying or printing a large number of sheets, the photoreceptor surface tends to result in degradation as well as abrasion.

Further, the organic photoreceptors exhibit a large contact energy toward the toner, which visualizes electrostatic latent images formed on the photoreceptor. As a result, after transferring the toner image to a transfer material in the transfer process, it is difficult to completely remove the residual toner which remains on the photoreceptor. Accordingly, during cleaning of the photoreceptor surface, various problems tend to occur.

On the other hand, in the image forming process utilizing the electrophotographic system, image formation, utilizing a digital system, has been playing a main role due to the recent progress of digital technology. In the image formation utilizing the digital system, an image of minute dots comprised of pixels such as 400 dpi (dots per inch) is basically visualized. Accordingly, a high quality image technology is demanded to faithfully reproduce such minute-dot images.

On the other hand, in order to minimize degradation of the organic photoreceptor surface due to cleaning, proposed have been various techniques to enhance the mechanical strength of the photoreceptor surface. Japanese Patent Publication Open to Public Inspection No. 9-258460 proposes a photoreceptor comprising a polycarbonate resin of high hardness on the surface layer. The photoreceptor comprising the polycarbonate resin is different from conventional ones and results in less surface abrasion due to cleaning. As a result, the frictional force against a cleaning blade (hereinafter occasionally referred to as a blade) increases. Thus, when a conventional cleaning blade is employed for cleaning, cleaning problems tend to occur, in which the blade is subjected to curl-under, whereby a toner is not completely removed due to vibrational fluctuation of the blade.

On the other hand, Japanese Patent Publication Open to Public Inspection No. 5-341701 proposes a technique in which, as a means to damp blade vibration, a toner cleaning device is provided with a vibration damping means. However, in the vibration damping technique described herein, vibration is damped employing a vibration damping means which is also employed as the blade holding member linearly joined to the blade. Accordingly, the vibration of the blade itself is not sufficiently damped. At the same time, it is difficult to achieve a stable enough connection due to the small joined area between the blade and the holding member. Therefore, blade vibration tends to become unstable.

Further, one other technique to achieve high image quality is a toner production technique. Heretofore, a so-called pulverized toner has been mainly employed to form electrophotographic images. The pulverized toner is prepared as follows: after blending and kneading resins and pigments, the resulting mixture is pulverized, and the resulting toner powder is classified employing a classifying process. However, the toner so prepared, employing the production processes, exhibits a limit in make the particle size distribution uniform. Accordingly, the toner results in insufficient particle size distribution as well as insufficient uniformity of particle shape. As a result, in the electrophotographic images prepared employing the pulverized toner, it is difficult to sufficiently achieve high image quality.

In recent years, as a means to make the particle size distribution as well as the shape of toner particles more uniform, an electrophotographic developer or an image forming method utilizing a polymerization toner has been proposed. The polymerization toner is prepared by dispersing monomers as the raw material into a water-based medium and subsequently subjecting then the monomers to polymerization. As a result, a toner is prepared which has a uniform particle size distribution as well as uniform particle shape.

When the polymerization toner is used in an image forming apparatus, employing the organic photoreceptor, new technical problems occur. Namely, as noted above, the shape of the polymerization toner particles is formed during the polymerization process of monomers, whereby the resulting shape is nearly spherical. As is well known, spherically shaped toner particles, which remain on the organic photoreceptor, tend to result in insufficient cleaning. Specifically, the surface of the organic photoreceptor tends to result in abrasion. When toner particles are adhered onto roughened surfaces formed through the abrasion, fine toner particles, which do not affect image formation, are not removed over an extended period of time and stain charging members (such as a charging wire and a charging roller), so that halftone images result in image unevenness.

In order to overcome cleaning problems such as blade curl-under as well as insufficient residual toner removal due to its passing under the blade with curl-under which result in the image forming method employing the polymerization toner, heretofore various proposals have been made. Of these, it has been proposed that the shape of polymerization toner particles be varied from a sphere to a spheroid, and the surface of polymerization toner particles be formed so as to exhibit roughness. However, these proposals have not sufficiently overcome the problems.

On the other hand, as the image forming apparatus utilizing the electrophotographic system, Japanese Patent Publication Open to Public Inspection No. 2001-109212 proposes an image forming apparatus which is constituted in such a manner that a toner cleaning device is provided just above the cylindrical photoreceptor. The image forming apparatus, which is constituted employing such an arrangement of the toner cleaning device as above, exhibits the advantage of being capable of being constituted in small dimensions. However, the image forming apparatus tends to result in insufficient cleaning due to the following reason. The toner cleaning device is provided above the photoreceptor and the cleaning blade is brought into pressure contact with the moving photoreceptor in a nearly horizontal direction from the upper side. As a result, toner particles scraped by the cleaning blade tend not to leave the photoreceptor surface resulting often in cleaning failure.

Specifically, when the polymerization toner is applied to an image forming apparatus which is constituted in a manner such that the toner cleaning device is provided just above the cylindrical organic photoreceptor, fine toner particles, which do not affect image formation, are not removed over an extended period of time and therefore stain charging members (such as the charging wire and the charging roller), whereby halftone images result in image unevenness.

SUMMARY OF THE INVENTION

A first object of the present invention is to provide a toner cleaning device which solves the aforesaid problems, is capable of maintaining excellent cleaning performance, resulting in no image defects, and forming excellent electrophotographic images for an extended period of time, when an organic photoreceptor as well as a polymerization toner is employed; an image forming method using the toner cleaning device; and an image forming apparatus using the toner cleaning device.

A second object of the present invention is to provide a toner cleaning device which solves the aforesaid problems and minimizes insufficient cleaning, which tends to occur in a toner cleaning device which is constituted in a manner such that the cleaning blade is provided just above the cylindrical organic photoreceptor (hereinafter referred to as a cylindrical photoreceptor, an organic photoreceptor, or simply a photoreceptor), maintains excellent cleaning performance, results in no image defects, and forms excellent electrophotographic images for an extended period of time when a polymerization toner is employed; an image forming method using the toner cleaning device; and an image forming apparatus using the toner cleaning device.

The inventors of the present invention conducted intensive investigations to solve the aforesaid problems. As a result, it has become possible to assure excellent cleaning properties as well as to maintain stabilized vibration of the cleaning blade (hereinafter occasionally referred to as the blade) by adhering a damping martial onto the cleaning blade or its supporting member, whereby it has become possible to overcome the problems. Namely, it was discovered that the first object of the present invention was achieved by employing any of the structures described below.

1. In a toner cleaning device provided with a cleaning blade which removes toner which remains on an organic photoreceptor after developing an electrostatic latent image formed on the organic photoreceptor, employing a developer containing toner and transferring a toner image formed by the development on the photoreceptor to a transfer material, a toner cleaning device wherein the cleaning blade and the supporting member of the cleaning blade are partially joined in parallel, and a damping material is adhered onto the cleaning blade.

2. In a toner cleaning device provided with a cleaning blade which removes toner which remains on an organic photoreceptor after developing an electrostatic latent image formed on the organic photoreceptor, employing a developer containing a toner and transferring a toner image formed by the development on the photoreceptor to a transfer material, a toner cleaning device wherein the cleaning blade and the supporting member of the cleaning blade are partially joined in parallel, and a damping material is adhered onto the supporting member.

3. In a toner cleaning device provided with a cleaning blade which removes toner which remains on an organic photoreceptor after developing an electrostatic latent image formed on the organic photoreceptor, employing a developer containing a toner and transferring a toner image formed by the development on the photoreceptor to a transfer material, a toner cleaning device wherein the cleaning blade and the supporting member of the cleaning blade are partially joined in parallel, and a damping material is adhered between the cleaning blade and the supporting member.

4. The toner cleaning device, described in any one of 1 through 3 above, wherein a viscoelastic material having a maximum loss factor $\eta_{max}$ of 0.3 to 2.0 is employed as the damping material.

5. The toner cleaning device, described in any one of 1 through 4 above, wherein $S_1/S_2$ is in the range of 0.05 to 12, wherein $S_1$ represents the damping material adhesion area and $S_2$ represents the area of the cleaning blade.

6. An image forming method wherein toner which remains on the organic photoconductor is removed employing the toner cleaning device, described in any one of 1 through 5 above, after developing an electrostatic latent image formed on the organic photoreceptor, employing a developer containing a toner and transferring a toner image formed by the development on the photoreceptor onto a transfer material.

7. The image forming method, described in 6 above, wherein as the toner, a toner having a variation coefficient, of the shape coefficient of toner particles, of no more than 16 percent and a number variation coefficient in the number particle size distribution of the toner particles of no more than 27 percent is employed.

8. The image forming method, described in 6 above, wherein as the toner, employed is a toner containing toner particles having a shape coefficient in the range of 1.2 to 1.6 in a ratio of at least 65 percent by number.

9. The image forming method, described in 6 above, wherein as the toner, employed is a toner containing toner particles without corners in a ratio of 50 percent by number.

10. An image forming apparatus wherein the image forming method described in any one of 6 through 9 above, is employed.

Further, in the toner cleaning device which is structured in such a manner that a cleaning blade is provided just above the cylindrical organic photoreceptor, it has become possible to assure excellent cleaning properties as well as to produce excellent electrophotographic images over an extended period of time. Namely, it was discovered that the second object of the present invention was achieved employing any of the structures described below.

11. In a toner cleaning device having a cleaning blade for removing a toner on a cylindrical organic photoreceptor provided so that the central axis of the cylinder is almost horizontally arranged and the leading edge of the cleaning blade comes into contact with the cylindrical organic photoreceptor within a cylinder center angle of $\beta \pm 30$ degrees (the upper direction perpendicular to the cylinder's center axis is designated as 0 degree), a toner cleaning device wherein the cleaning blade and the cleaning blade supporting member are partially joined to each other in parallel, and a damping material is adhered onto the cleaning blade.

12. In a toner cleaning device having a cleaning blade for removing a toner on a cylindrical organic photoreceptor provided so that the central axis of the cylinder is almost horizontal and the leading edge of the cleaning blade comes into contact with the cylindrical organic photoreceptor within a cylinder center angle of β±30 degrees (the upper direction perpendicular to the cylinder center axis is designated as 0 degree), a toner cleaning device wherein the cleaning blade and the cleaning blade supporting member are partially joined to each other in parallel, and a damping material is adhered onto the supporting member.

13. In a toner cleaning device having a cleaning blade for removing a toner on a cylindrical organic photoreceptor provided so that the central axis of the cylinder is almost horizontal and the leading edge of the cleaning blade comes into contact with the cylindrical organic photoreceptor within a cylinder center angle of β±30 degrees (the upper direction perpendicular to the cylinder center axis is designated as 0 degree), a toner cleaning device wherein the cleaning blade and the cleaning blade supporting member are partially joined to each other in parallel, and a damping material is adhered between the cleaning blade and the damping material.

14. The toner cleaning device, described in any one of 11. through 13 above, wherein a viscoelastic material having a maximum loss factor $\eta_{max}$ of 0.3 to 2.0 is employed as the damping material.

15. The toner cleaning device, described in any one of 11 through 14 above, wherein $S_1/S_2$ is in the range of 0.05 to 12, wherein $S_1$ represents the damping material adhesion area and $S_2$ represents the area of the cleaning blade.

16. In an image forming method employing a toner cleaning device which removes a toner remaining on a cylindrical organic photoreceptor after forming a toner image, utilizing a development means, from an electrostatic latent image formed on the cylindrical organic photoreceptor which is arranged so that the cylinder central axis is nearly horizontal, and transferring the toner image to a transfer material, an image forming method wherein the toner cleaning device is one described in any one of 11 through 15 above.

17. The image forming method, described in 16 above, wherein employed as the toner employed for the development means is a toner which has a variation coefficient, of the shape coefficient of toner particles, of no more than 16 percent, and a number variation coefficient of the number particle size distribution of the toner particles of no more than 27 percent.

18. The image forming method, described in 16 or 17 above, wherein employed as the toner used for the development means is a toner which contains toner particles having a shape coefficient in the range of 1.2 to 1.6 in a ratio of 65 percent by number.

19. The image forming method, described in any one of 16 through 18 above, wherein employed as the toner used for the development means is one which contains toner particles without corners in a ratio of at least 65 percent by number.

20. An image forming apparatus employing the image forming method described in any one of 16 through 19 above.

BRIEF DESCRIPTION OF THE DRAWINGS

FIG. 16(*a*) is a view explaining the projection image of a toner particle without corners, and FIGS. 16(*b*) and 16(*c*) are views explaining the projection images of a toner particle with corners.

FIGS. 20(*a*) through 20(*g*) are views showing specific examples of other adhesion of damping materials.

DETAILED DESCRIPTION OF THE PREFERRED EMBODIMENTS

The present invention will now be detailed.

The inventors of the present invention discovered that, by employing the aforesaid structures, it is possible to effectively remove residual toner particles remaining on an organic photoreceptor without resulting in an excessive friction force between the organic photoreceptor and the cleaning blade while minimizing blade curl-under as well as residual toner particles, and to obtain excellent and consistent images over an extended period of time. The present invention will now be detailed hereunder.

Figure 1:
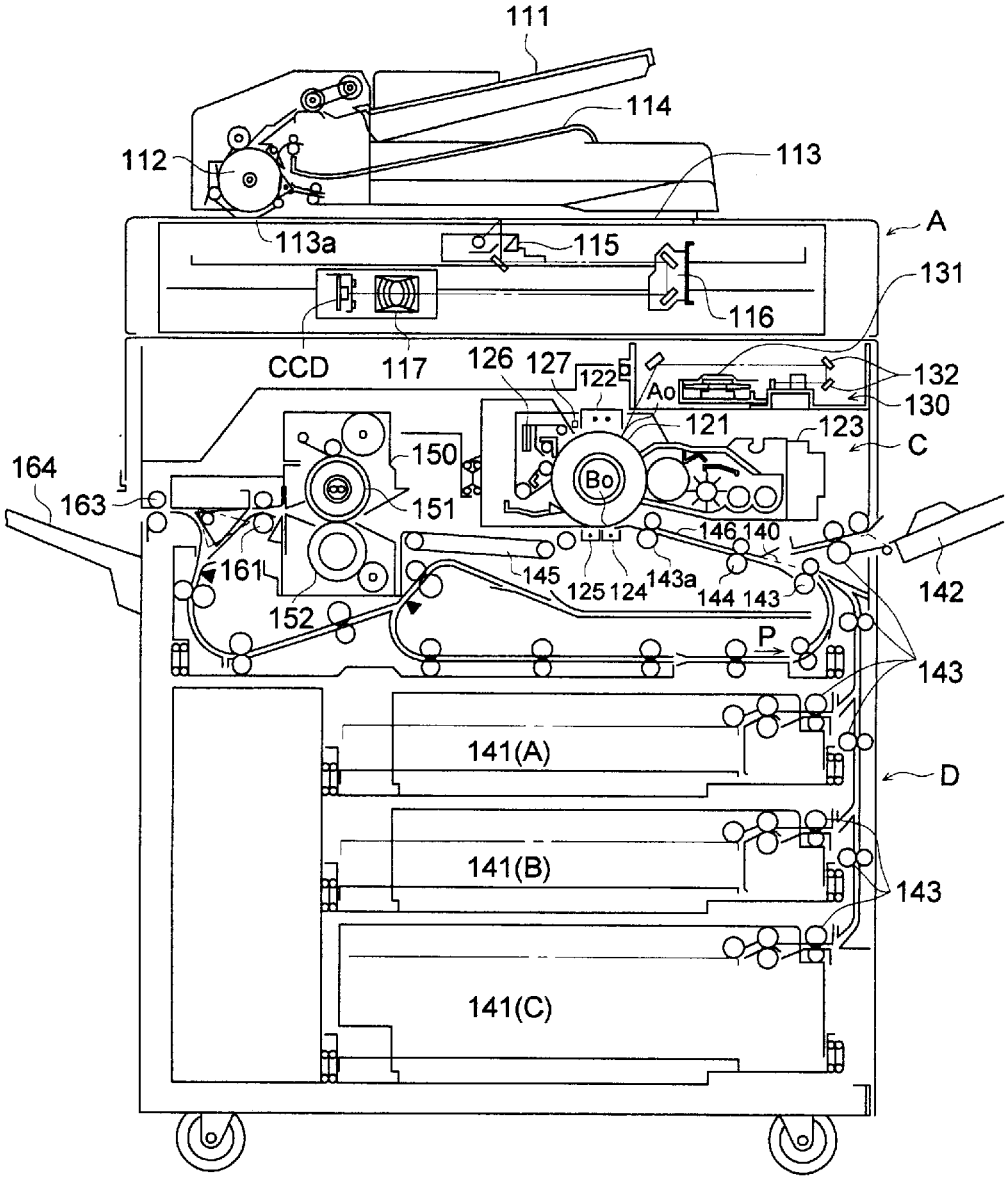
FIG. 1 is a schematic view showing the whole structure of the image forming apparatus of the present invention.

FIG. 1 is a schematic view showing the whole structure of an image forming apparatus of the present invention.

The image forming apparatus shown in FIG. 1 is one based on a digital system and is comprised of image reading section A, image processing section B (not shown), image forming section C, and transfer paper conveying section D.

In the upper section of image reading section A, provided is an automatic original document feeding means which automatically feeds the original documents. Original documents, which are placed on document feeding table 111, are separately conveyed sheet by sheet via original document conveying roller 112, and image reading is carried out at reading position 113*a*. The original document, which has been read, is ejected onto document ejecting tray 114, utilizing document conveying roller 112.

On the other hand, the image of the original document, which is placed on platen glass 113, is read by reading operation at a speed of v of first mirror unit 115 comprised of an illuminating lamp and a first mirror which constitutes an optical scanning system, as well as by movement at a speed of v/2 in the same direction of second mirror unit 116 comprised of a second mirror and a third mirror which are arranged in a V shape.

The read image is focused via projection lens 117 onto the receptor surface of imaging line sensor CCD. The linear optical image, which has been focused onto imaging sensor CCD, is successively subjected to photoelectric conversion to obtain electric signals (brightness signals), and thereafter, is subjected to A/D conversion. The resultant signals are then subjected to various processes such as density conversion, a filtering process, and the like, in image processing section B, and then the resultant image data are temporarily stored in a memory.

In image forming section C, arranged as image forming units are drum-shaped image bearing photoreceptor 121 (hereinafter referred to also as a photoreceptor drum), and around the photoreceptor drum, charging unit 122 as the charging means, development unit 123 as the development means, transfer unit 124 as the transfer means, separating unit 125 as the separating means, toner cleaning device 126 and PCL (pre-charge lamp) 127, in the order for each cycle. Photoreceptor 121 is prepared by applying photoconductive compounds onto a drum base body. For example, organic photoreceptors (OPC) are preferably employed. The drum rotates clockwise as shown in FIG. 1.

After the rotating photoreceptor is uniformly charged employing charging unit 122, image exposure is carried out based on image signals retrieved from the memory of image processing section B, employing exposure optical system 130. In the exposure optical system 130, which is utilized as the writing means, a laser diode (not shown) is employed as the light emitting source, and primary scanning is carried out in such a manner that light passes through rotating polygonal mirror 131, an fθ lens (having no reference numeral), and a cylindrical lens (also having no reference numeral), and the light path is deflected by reflection mirror 132. As a result, image exposure is carried out at position $A_0$ with respect to photoreceptor 121, and a latent image is formed by the rotation (secondary scanning) of photoreceptor 121. In one example of the present embodiment, exposure is carried out for the text sections and the latent image is formed.

The latent image on photoreceptor 121 is subjected to reversal development employing development unit 123, and a visualized toner image is formed on the surface of the photoreceptor 121. In transfer paper conveying section D, under the image forming unit provided are paper feed units 141(A), 141(B), and 141(C) as paper sheet storing means, in which different-sized sheets of transfer paper P (being a transfer material) are stored, and provided on the exterior, is manual paper feeding unit 142 by which paper sheets are manually fed. Transfer paper P, which is selected from any of these paper feeding units is conveyed along conveying path 140 employing paired guide rollers 143, and the conveyance of transfer paper P is temporarily suspended by paired registration rollers 144 which correct for any inclination as well as any deviation of transfer paper P, and thereafter the conveyance resumes. Transfer paper P is guided in conveyance path 140, by paired pre-transfer rollers 143*a* and guide plate 146, so that the toner image on photoreceptor 121 is transferred onto transfer paper P at transfer position $B_0$ employing transfer unit 124. Subsequently, charge elimination is carried out employing separation unit 125; transfer paper P is separated from the surface of photoreceptor 121 and is conveyed to fixing unit 150, employing conveying unit 145.

Fixing unit 150 comprises fixing roller 151 as well as pressure roller 152. By passing transfer paper P between fixing roller 151 and pressure roller 152, heat as well as pressure is applied to melt-fix the toner. Transfer paper P, which has been subjected to fixing of its toner image, is ejected onto paper storage tray 164.

Figure 2:
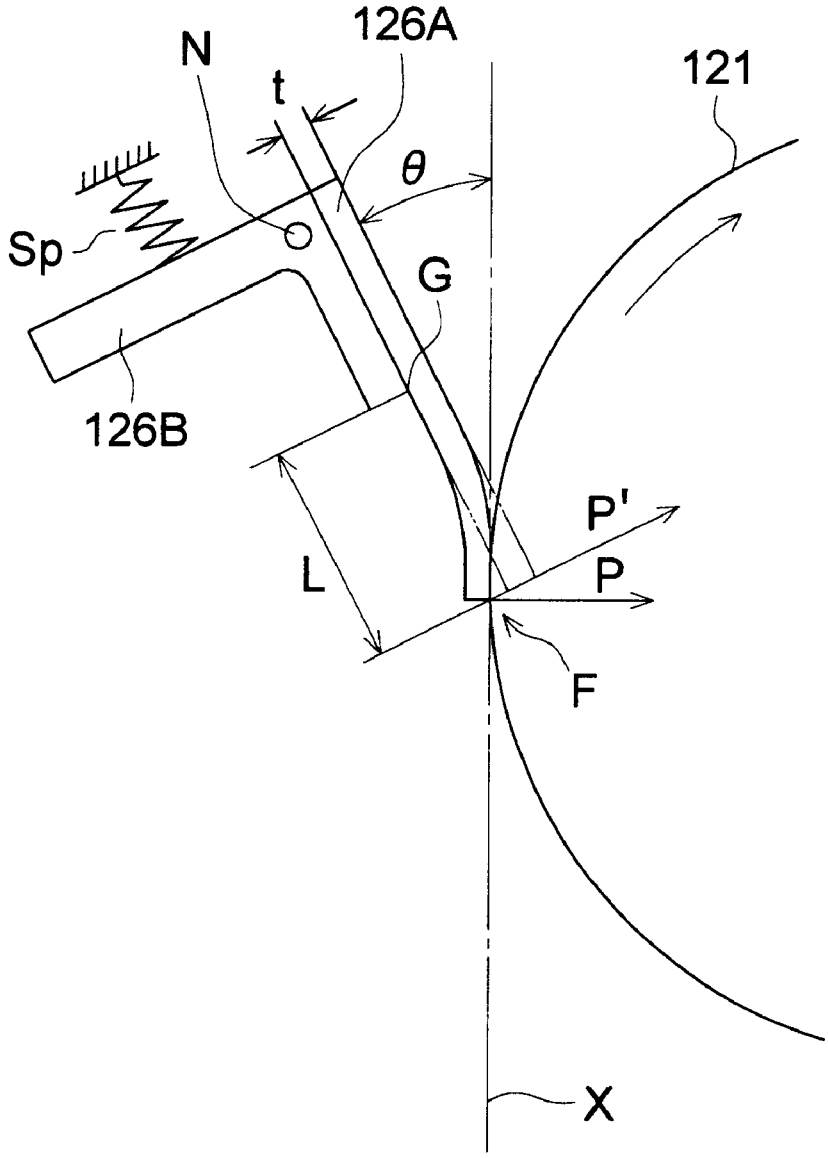
FIG. 2 is a schematic view showing a structure of a toner cleaning device employing the cleaning blade of the present invention.

FIG. 2 is a view showing the structure of a toner cleaning device employing the cleaning blade of the present invention.

In the toner cleaning device, cleaning blade 126A is attached to supporting member 126B. Employed as materials of the cleaning blade are rubber elastic bodies, and known as the materials are urethane rubber, silicone rubber, fluorinated rubber, chloroprene rubber, and butadiene rubber. Of these, urethane rubber is particularly preferred, since its abrasion properties are superior to the others. For example, the urethane rubber, described in Japanese Patent Publication Open to Public Inspection No. 59-30574, is preferred which is prepared by allowing polycaprolactone ester to react with polyisocyanate.

On the other hand, the supporting member 126B is comprised of plate-shaped metallic materials and plastic materials. Preferably employed as metallic materials are stainless steel plates, aluminum plates, or damping steel plates.

Figure 3:
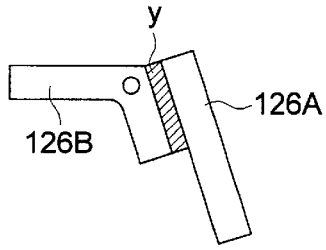
FIGS. 3(*a*) through 3(*g*) are views showing specific examples of effective adhesion of damping materials.
Figure 3:
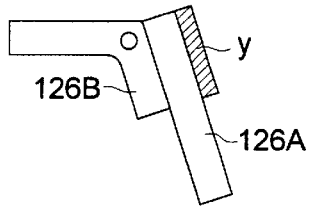
Figure 3:
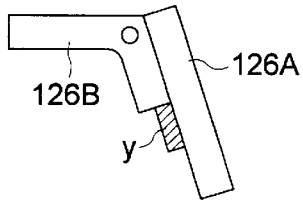
Figure 3:
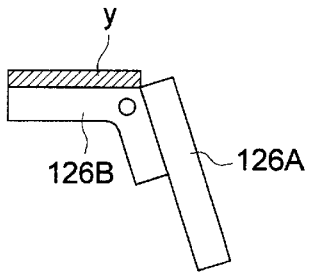
Figure 3:
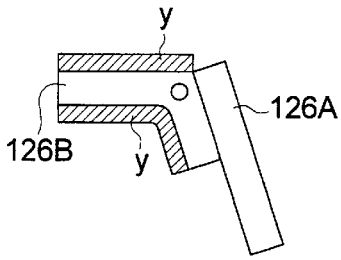
Figure 3:
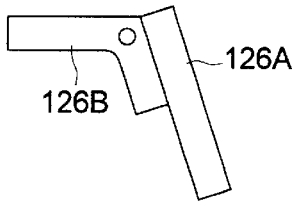
Figure 3:
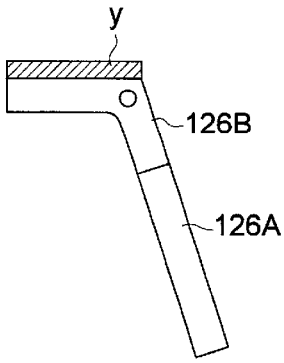

It is characterized in that the cleaning blade and the supporting member are partially joined to each other in parallel. Connection in parallel, as described herein, means that the supporting member and the blade are joined while being overlapped, and namely, as shown in FIGS. 3(*a*) through 3(*f*), the supporting member and the blade are overlapped with each other in parallel and joined on the face of the surface. On the other hand, joining in series, as described herein, means that as shown in FIG. 3(*g*), the supporting member and the blade are joined end to end.

In the present invention, by joining the cleaning blade with the supporting member in parallel, it is possible to assure sufficient joining surface area of the cleaning blade with the supporting member. As a result, a stable joint is achieved, whereby it is possible to stabilize the resulting blade vibration. In addition, by adhering the damping material onto either the supporting member or the cleaning blade, it is possible to more effectively damp the vibration of the cleaning blade. As a result, it is possible to achieve excellent cleaning which does not result in insufficient residual toner removal as well as blade curl-under.

In order to assure uniform joint strength, the shortest width of the joint area of the blade with the supporting member is commonly at least 3 mm, and is preferably at least 5 mm. It is possible to carry out adhesion of the blade with the supporting member utilizing adhesives such as thermoplastic resinous adhesives, thermosetting adhesive, double sided adhesive tapes, or combinations of the double sided adhesive tape with the adhesives.

The optimal pressure contact conditions of the cleaning blade onto the photoreceptor surface are determined depending on the delicate balance of various properties and their range is fairly narrow. The conditions vary depending on the properties of the thickness of the cleaning blade. As a result, relatively high accuracy is required for setting. However, during production of the cleaning blades, small fluctuations of the thickness inevitably occur. Accordingly, the cleaning blade does not always meet optimal conditions. Further, even though the cleaning blade is properly set at first, during use, settings occasionally are beyond the proper range due to its narrowness. Specifically, when combined with an organic photoreceptor, employing a polymer binder, setting beyond the range results in the blade curl-under as well as insufficient residual toner removal.

Accordingly, in order to minimize the fluctuation of properties of the cleaning blade, the present invention provides an effective means. Even though the thickness of the cleaning blade fluctuates, the vibration of the blade is effectively damped utilizing the damping material adhered onto the blade or the supporting member. As a result, it is possible to continuously maintain setting conditions of the cleaning blade onto the photoreceptor within the optimal range.

In the present invention, the edge of a cleaning blade, which is brought into pressure contact with the photoreceptor surface, is preferably brought into contact with the photoreceptor in the direction opposite of the rotation of the photoreceptor, in a load applied state. As shown in FIG. 2, it is preferable that the edge of the cleaning blade, when brought into pressure contact with the photoreceptor, forms a pressure contact plane.

As shown in FIG. 2, the preferred values of contact load P and contact angle θ of the cleaning blade to the photoreceptor is from 5 to 40 N/m and from 5 to 35 degrees, respectively.

The contact load P is a vector value in the normal line direction of pressure contact force P' when blade 126B is brought into pressure contact with photoreceptor drum 121.

Further, contact angle θ is the angle between tangential line X and the blade prior to deformation (shown as the dotted line in FIG. 2) at contact point F. N is a pivoting point which allows the supporting member to be rotatable, and Sp is a load spring.

Further, as shown in FIG. 2, free length L of the cleaning blade is the length between the position of tip G of supporting member 126B and the tip of the blade prior to deformation. The free length L is preferably from 6 to 15 mm. Thickness t of the cleaning blade is preferably from 0.5 to 10 mm. Herein, the thickness of the cleaning blade, as described in the present invention, refers to the perpendicular direction with respect to the adhesion plane of supporting member 126B, as shown in FIG. 2.

Further, as one of the physical properties of the cleaning blade, its JIS A hardness is preferably in the range of 55 to 90 at 25±5° C. When the hardness is 55 or less, cleaning performance tends to degrade, while when exceeding 90, blade curl-under tends to occur. Still further, the impact resilience is preferably in the range of 25 to 80. When the impact resilience exceeds 80, blade curl-under tends to occur, while when it is less than 25, cleaning performance degrades. The Young modulus of the cleaning blade is preferably in the range of 294 to 599 N/cm$^2$.

Further, it is preferable that a fluorine based lubricant is sprayed onto the edge of the cleaning blade in contact with the photoreceptor, or a dispersion, prepared by dispersing fluorine based polymers and fluorine based resin powders into fluorine based solvents, is further applied onto the entire edge of the width.

The damping material, as described in the present invention, refers to the material which is adhered to the cleaning blade or its supporting member so as to minimize vibration. Any material may be employed as long as it exhibits damping effects.

Preferred as specific damping materials are those which damp the magnitude of vibration by at least 20 percent, compared to cases without the damping materials, when the magnitude of vibration is determined employing the method described below to obtain the damping effects.

(Method for Determining the Vibration Magnitude)

The sensor of an acceleration detecting meter NP-3210, manufactured by Ono Sokki Co., was fitted with the supporting member adhered to the cleaning blade in parallel. When the photoreceptor rotates at a constant rate, vibration is recorded for 10 seconds employing the sensor. Output data from the sensor are processed employing Ono Sokki CF6400 4-Channel Intelligent FF Analyzer, and the average of amplitude of the vibration is obtained, which is represented by the magnitude (in nm) of the vibration of the blade. However, when a damping material is adhered at the sensor fitted position, measurement is carried out upon removal of the damping material at the sensor fitted position.

Further, preferred as damping materials of the present invention are viscoelastic materials which simultaneously exhibit both properties of viscosity and elasticity. Viscoelastic materials, which are preferably employed in the present invention, preferably have a maximum η value ($\eta_{max}$, being the maximum loss factor) in the range 0.3 to 2.0 and more preferably in the range of 0.5 to 1.5, wherein η is defined as the ratio of $G^2/G^1$ wherein $G^1$ is the dynamic modulus of shearing elasticity represented by a real number and $G^2$ is the dynamic loss factor represented by an imaginary part, when periodic damping properties determined at a vibration frequency in the range (the abscissa of FIG. 4) of $10^{-2}$ to $10^7$ Hz (temperature in the range of 0 to 100° C. as the parameter) are represented utilizing complex numbers. Viscoelastic materials, which have $\eta_{max}$ in the range, exhibit large damping effects. Further, $G^1$, when $\eta_{max}$ is obtained, is preferably from $6.9\times10^2$ to $6.9\times10^4$ kPa.

Figure 4:
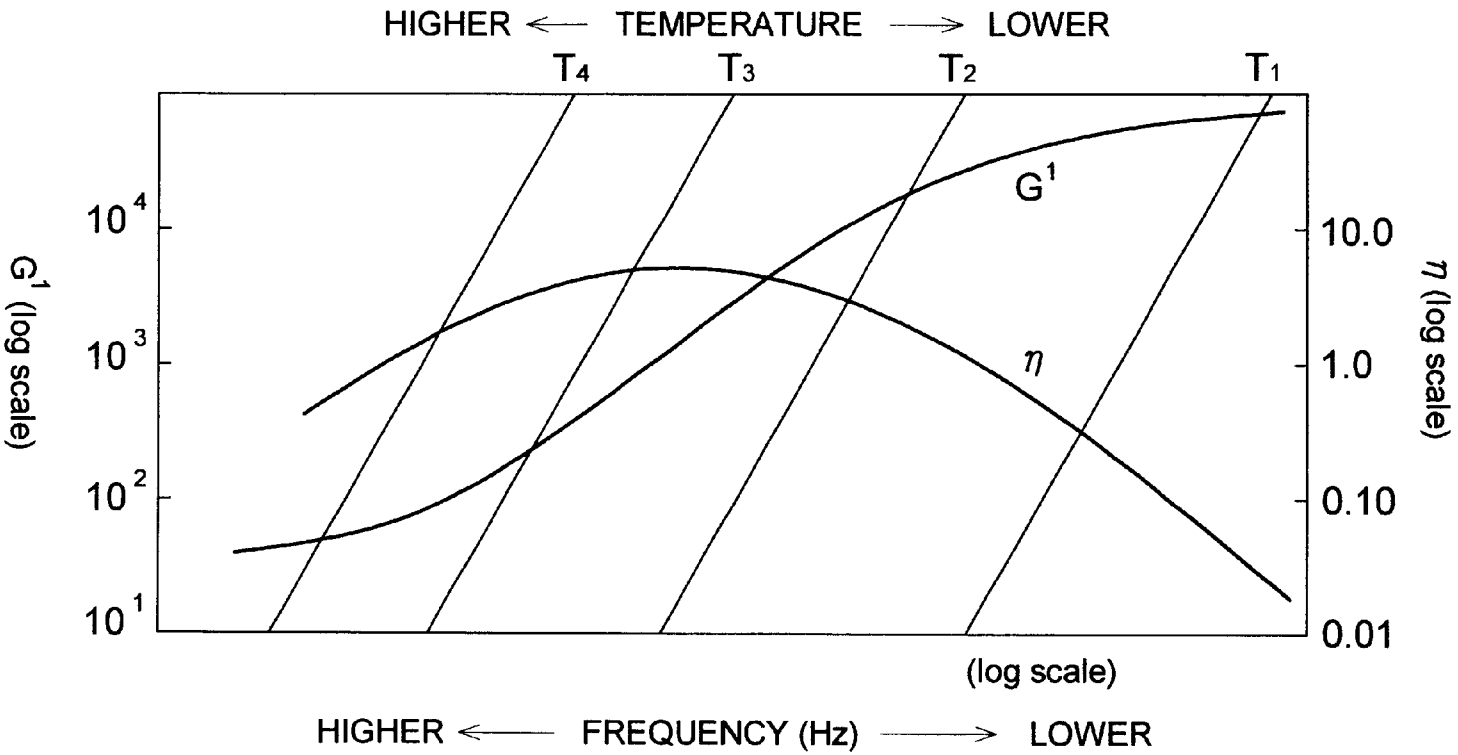
FIG. 4 is a graph showing frequency dependability of η.

The periodic damping properties are determined employing a high frequency viscoelaciticity spectrometer VES-HC (manufactured by Iwazaki Seisakusho). It is possible to obtain $\eta_{max}$ from the graph which shows the frequency dependence of η, as shown in FIG. 4.

The damping materials include commercially available ones such as VEM Series, manufactured by Sumitomo 3M Limited and LR Series Damper, manufactured by Bridgestone Corp. In addition to these, it is possible to prepare damping materials of properties of the $G^1$ as well as $\eta_{max}$ by combining damping materials.

On the other hand, by adhering any of these damping materials to the cleaning blade or the supporting member, it is possible to effectively damp the vibration of the cleaning blade and its supporting member. As a result, cleaning properties are improved, and blade curl-under is minimized.

FIG. 3 shows specific examples of adhesion of damping materials.

In FIG. 3, "y" (the oblique line part) is the damping material, 126A is the cleaning blade, and 126B is the supporting member.

FIGS. 3(*a*) through 3(*e*) are examples of the present invention, while FIGS. 3(*f*) and 3(*g*) are not an example of the present invention.

In FIGS. 3(*b*) through 3(*e*), cleaning blade 126A and supporting member 126B are directly adhered to each other and joined in parallel. On the other hand, in FIG. 3(*f*), the damping material is not used, and in FIG. 3(*g*), cleaning blade 126A and supporting member 126B are joined end to end.

FIG. 3(*a*) shows an example in which damping material y is adhered between the cleaning blade 126A and the supporting member 126B; FIG. 3(*b*) shows an example in which damping material y is adhered onto the cleaning blade; FIGS. 3(*c*) through 3(*e*) show examples in which damping material y is adhered onto the supporting member. By employing damping materials in the manner as above, and as shown in the results of examples described below, FIGS. 3(*a*) through 3(*e*) exhibit excellent cleaning properties such as minimizing insufficient residual toner removal as well as minimizing the formation of blade curl-under.

Figure 5:
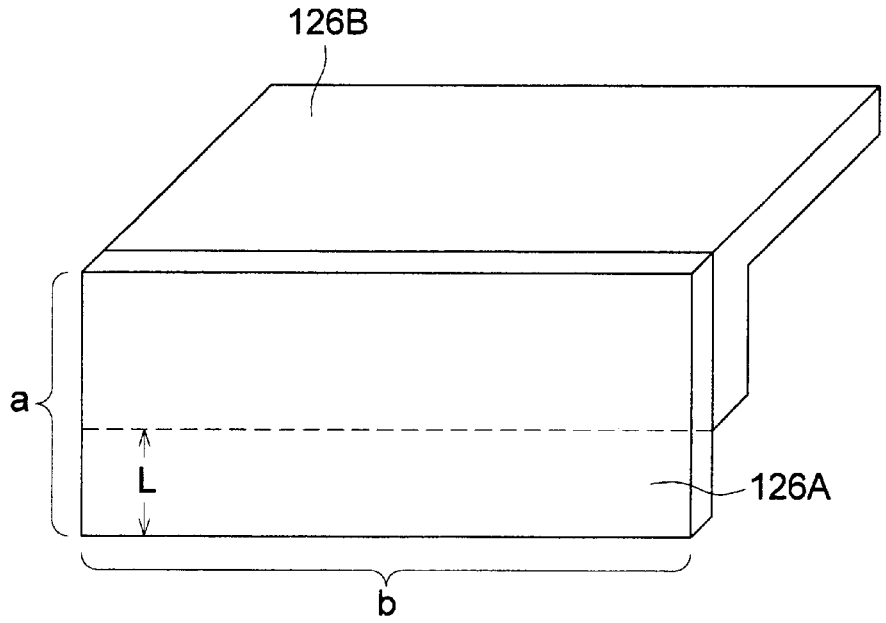
FIG. 5 is a view showing the area of a cleaning blade.

$S_1/S_2$ is preferably in the range of 0.05 to 12, wherein $S_1$ is the adhesion area of the damping material and $S_2$ is the cleaning blade area (being the product of the length "a" of the cleaning blade in the free length direction in FIG. 5 and length "b" of the photoreceptor in the axis direction). When $S_1/S_2$ is less than 0.05, the desired effects of the present invention are barely noted, while when it exceeds 12, the effects can hardly be enhanced. Further, $S_1/S_2$ is more preferably in the range of 0.3 to 5.0, and is most preferably in the range of 0.5 to 3.0.

$S_1<S_2$ refers to the case in which the adhesion area of the damping material is less than the area of the cleaning blade, as example, when the damping material is adhered as shown in FIGS. 3(*a*) through 3(*d*). In this case, FIGS. 3(*a*) through 3(*c*), in which the blade is brought into direct contact, are particularly preferred.

$S_1=S_2$ refers to the case in which the adhesion area of the damping material equals the area of the cleaning blade, and any of FIGS. 3(*a*) through 3(*d*) may be available. However, FIGS. 3(*a*) and 3(*b*) are particularly preferred.

$S_1>S_2$, as described herein, refers to the case, for example, shown in FIG. 3(*e*), or the case in which adhesion is carried out so as to be greater than the area of the cleaning blade in such a manner that the damping material is adhered onto the entire toner cleaning device.

Adhesion of the damping material onto the cleaning blade or the supporting member may be carried out employing double faced adhesive tape or adhesives. However, when available damping materials are tape-form or sheet-type and function as adhesives, they may be employed without any modification.

Photoreceptors will now be described.

The organic electrophotographic photoreceptors (the organic photoreceptors), as described in the present invention, refer to electrophotographic photoreceptors which are constituted employing organic compounds which exhibit at least either a charge generating function or a charge transport function which are inevitable for constituting the electrophotographic photoreceptor, and include all organic electrophotographic photoreceptors known in the art, such as those which are constituted employing organic charge generating materials, or organic charge transport materials known in the art, and photoreceptors comprised of molecular complexes in which the charge generating function as well as the charge transport function is enhanced.

The constitution of organic photoreceptors employed in the present invention will now be described.

(Conductive Support)

Employed as conductive supports may be either a sheet-type support or a cylindrical support. However, in order to reduce the overall dimensions of an image forming unit, the cylindrical conductive support is more preferred.

A cylindrical conductive support, as described herein, refers to a cylindrical support which is required to make it possible to form images endlessly through repeated rotation. The conductive support preferably has a range of circularity of 0.1 mm or less, and a deviation of 0.1 mm or less. When the circularity as well as the deviation is beyond the range, it becomes difficult to maintain excellent image formation.

Employed as conductive materials may be metallic drums comprised of aluminum and nickel, plastic drums with vacuum evaporated aluminum, tin oxide, and indium oxide, or paper-plastic drums coated with conductive materials. The resistivity of conductive supports is preferably no more than $10^3$ Ωcm at normal temperature.

In the present invention, employed may be a conductive support on which surface a sealed anodized aluminum layer is formed. Sealing is commonly carried out in an acidic bath comprised of, for example, chromic acid, sulfuric acid, oxalic acid, phosphoric acid, boric acid, or sulfamic acid. However, an anodic oxidation treatment in sulfuric acid gives the most preferred results. In the case of the anodic oxidation treatment in sulfuric acid, the concentration of sulfuric acid is preferably from 100 to 200 g/L, while the preferred aluminum ion concentration is preferably from 1 to 10 g/L. The bath temperature is preferably about 20° C. and the applied voltage is commonly no more than 20 V, which are not particularly limited to the values. Further, the average thickness of the anodic oxidation layer is commonly no more than 20 μm, and is more preferably no more than 10 μm.

(Interlayer)

In the present invention, it is possible to provide an interlayer exhibiting a barrier function between the conductive support and the photosensitive layer.

In the present invention, in order to enhance adhesion between the conductive support and the photosensitive layer, or to minimize charge injection from the support, it is possible to provide an interlayer (including a sublayer) between the support and the photosensitive layer. Listed as materials for the interlayer are polyamide resins, vinyl chloride resins, and vinyl acetate resins, as well as copolymer resins comprising at least two repeating units thereof. Of these subbing resins, preferred as resins capable of reducing an increase in residual potential during repeated use, are polyamide resins. Further, the thickness of the interlayer comprised of these resins is preferably from 0.01 to 0.50 μm.

Listed as interlayers most preferably employed in the present invention are those employing hardenable metallic resins prepared by thermosetting organic metallic compounds such as silane coupling agents and titanium coupling agents. The thickness of the interlayer prepared employing hardenable metallic resins is preferably from 0.1 to 2.0 μm.

(Photosensitive Layer)

The photosensitive layer configuration of the photoreceptor of the present invention may be one comprised of a single layer structure on the interlayer, which exhibits a charge generating function as well as a charge transport function. However, a more preferable configuration is that the photosensitive layer is comprised of a charge generating layer (CGL) as well as a separate charge transport layer (CTL). By employing the configuration in which the functions are separated, it is possible to control an increase in residual potential, resulting from repeated use at a low level, and to readily control other electrophotographic properties to desired values. A negatively charged photoreceptor is preferably structured in such a manner that applied onto the interlayer is the charge generating layer (CGL), onto which the charge transport layer (CTL) is applied. On the other hand, a positively charge photoreceptor is structured so that the order of the layers employed in the negatively charged photoreceptor is reversed. The most preferable photosensitive layer configuration is the negatively charged photoreceptor configuration having the function separation structure.

The photosensitive layer configuration of a function separated negatively charged photoreceptor will now be described.

(Charge Generating Layer)

The charge generating layer comprises charge generating materials (CGM). As to other materials, if desired, binder resins and other additives may be incorporated.

Employed as charge generating materials may be those commonly known in the art. For example, employed may be phthalocyanine pigments, azo pigments, perylene pigments, and azulenium pigments. Of these, CGMs, which are capable of minimizing the increase in residual potential, resulting from repeated use, are those which comprise a three-dimensional electrical potential structure capable of taking stable agglomerated structure between a plurality of molecules. Specifically listed are CGMs of phthalocyanine pigments and perylene pigments having a specific crystal structure. For instance, titanyl phthalocyanine having a maximum peak at 27.2° of Bragg angle 2θ with respect to a Cu-Kα line, benzimidazole perylene having a maximum peak at 12.4° of the Bragg 2θ, and the like, result in minimum degradation under repeated use, and can therefore minimize the increase in residual potential.

When, in the charge generating layer, binders are employed as the dispersion media of CGM, employed as binders may be any of the resins known in the art. Listed as the most preferable resins are formal resins, butyral resins, silicone resins, silicone modified butyral resins, and phenoxy resins. The ratio of binder resins to charge generating materials is preferably between 20 and 600 weight parts per 100 weight parts of the binder resins. By employing the resins, it is possible to minimize the increase in residual potential under repeated use. The thickness of the charge generating layer is preferably from 0.01 to 2.00 μm.

(Charge Transport Layer)

The charge transport layer comprises charge transport materials (CTM) as well as binders which disperse CTM and form a film. As to other materials, also incorporated may be additives such as antioxidants, if desired.

Employed as charge transfer materials (CTM) may be any of those known in the art. For example, it is possible to employ triphenylamine derivatives, hydrazone compounds, styryl compounds, benzidine compounds, and butadiene compounds. These charge transport materials are commonly dissolved in appropriate binder resins and are then subjected to film formation. Of these, CTMs, which are capable of minimizing the increase in residual potential under repeated use, are those which exhibit properties such as high mobility as well as an ionization potential difference of not more than 0.5 eV, and preferably not more than 0.25 eV from a combined CGM.

The ionization potential of CGM and CTM is determined employing Surface Analyzer AC-1 (manufactured by Riken Keiki Co.).

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors, such as poly-N-vinylcarbazole.

Most preferable as CTL binders are polycarbonate resins. Polycarbonate resins are most preferred because the dispersibility of CTM as well as electrophotographic properties is improved. In the case of photoreceptor in which the charge transport layer is employed as the surface layer, polycarbonates which exhibit high mechanical wear resistance are preferred and polycarbonates having an average molecular weight of 25,000 to 40,000 are also preferred. The average molecular weight, as described herein, may be either the number average molecular weight, the weight average molecular weight, or the viscosity average molecular weight. The ratio of binder resins to charge transport materials is preferably from 10 to 200 weight parts per 100 weight parts of the binder resins. Further, the thickness of the charge transport layer is preferably from 10 to 40 μm.

(Protective Layer)

Provided as protective layers of a photoreceptor may be various types of resinous layers. Specifically, it is possible to obtain an organic photoreceptor having high mechanical strength by providing a cross-linking resinous layer.

Listed as solvents or dispersion media which are employed to form layers such as interlayers, photosensitive layers, and protective layers, are n-butylamine, diethylamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dicholorethane, 1,2-dichloropropane, 1,1,2-trichloroethane, 1,1,1-trichloroethane, trichloroethylene, tetrachloroethane, tetrahydrofuran, dioxysolan, dioxane, methanol, ethanol, butanol, isopropanol, ethyl acetate, butyl acetate, dimethyl sulfoxide, methyl cellosolve, and the like. However, the present invention is not limited to these examples, and also preferably employed are dichloromethane, 1,2-dicholorethane, methyl ethyl ketone, and the like. Further, these solvents may be employed individually or in combination as a solvent mixture of two or more types.

Employed as coating methods to produce electrophotographic organic photoreceptors are dip coating, spray coating, and circular amount-regulating type coating. When an upper layer is applied onto the photosensitive layer, preferably employed coating methods such as spray coating or circular amount-regulating type coating (including a circular slide hopper type as its representative example) so that the dissolution of the lower layer is minimized and uniform coating is achieved. Incidentally, the protective layer is most preferably applied employing the circular amount-regulating type coating method. The circular amount-regulating type coating is detailed in, for example, Japanese Patent Publication Open to Public Inspection No. 58-189061.

The toner, which is employed in the present invention, will now be described.

Preferred as the toner is a polymerized toner in which the size distribution of individual toner particles as well as their shape is relatively uniform. The polymerized toner, as described herein, refers to a toner obtained in such a manner that binder resins for the toner as well the shape of toner particles are formed by polymerization of monomers as the raw materials of the binder resins, followed by chemical treatment. More specifically, the polymerized toner refers to a toner which is obtained by polymerization such as suspension polymerization, and emulsion polymerization, if desired, followed by a fusing process among particles which is carried out after the polymerization.

Preferred as the polymerized toner which is employed in the toner cleaning device employing the cleaning blade of the present invention is one having a specific shape of toner particles. The polymerized toner, which may preferably be employed in the present invention, will now be described.

The polymerized toner, which is preferably employed in the present invention, has a number ratio of toner particles having a shape coefficient of 1.2 to 1.6 and is at least 65 percent, and further the variation coefficient of the shape coefficient is not more than 16 percent. In the present invention, it was discovered that even though such a polymerized toner was employed, it was possible to stabilize the vibration of the cleaning blade, and exhibited excellent cleaning performance.

Further, the stability of the vibration of the cleaning blade is dependent on the diameter of toner particles. As the diameter of particles decrease, adhesion of toner particles to the image bearing body increases. As a result, the resultant vibration tends to become excessive, and toner particles are more likely not to be removed by the cleaning blade. On the other hand, toner particles, having a larger diameter, are more readily removed by the cleaning blade. However, problems occur in which image quality such as resolution, and the like, is degraded.

From the viewpoint of the foregoing, investigations were carried out. As a result, it was discovered that by employing a toner having a variation coefficient of the toner shape coefficient of not more than 16 percent, as well as having a number variation coefficient in the toner number size distribution of not more than 27 percent, it was possible to form high quality images, which exhibited excellent cleaning properties, as well as excellent fine line reproduction, over an extended period of time.

Further, by employing a toner in which the number ratio of toner particles having no corners is set at 50 percent, and the number variation coefficient in the number size distribution is adjusted to not more than 27 percent, it is possible to obtain high quality images over an extended time of period, which exhibit excellent cleaning properties, as well as excellent fine line reproduction.

The shape coefficient of the toner particles of the present invention is expressed by the formula described below and represents the degree of roundness of toner particles.

$$\text{Shape coefficient}=[(\text{maximum diameter}/2)^2\times\pi]/\text{projection area}$$

wherein the maximum diameter refers to the maximum width of a toner particle obtained by forming two parallel lines between the projection image of the particle on a plane, while the projection area refers to the area of the projected image of the toner on a plane.

In the present invention, the shape coefficient was determined in such a manner that toner particles were photographed under a magnification factor of 2,000, employing a scanning type electron microscope, and the resultant photographs were analyzed employing "Scanning Image Analyzer" (manufactured by Nihon Denshi Co.). At that time, 100 toner particles were employed and the shape coefficient of the present invention was obtained employing the aforesaid calculation formula.

The polymerized toner of the present invention is in that the number ratio of toner particles in the range of the shape coefficient of 1.2 to 1.6 is preferably at least 65 percent by number, and is more preferably at least 70 percent by number.

By adjusting the number ratio of toner particles in the range of a shape coefficient of 1.2 to 1.6 to at least 65 percent, the triboelectrical properties become more uniform on the developer conveying member, resulting in no accumulation of excessively charged toner particles, and thus the toner particles are more readily removed from the surface of the developer conveying member to minimize generation of problems such as development ghost. Further, the toner particles tend not to be crushed, resulting in decreased staining on the charge providing member and chargeability of the toner is stabilized.

Methods to control the shape coefficient are not particularly limited. For example, a method may be employed wherein a toner, in which the shape coefficient has been adjusted to the range of 1.2 to 1.6, is prepared employing a method in which toner particles are sprayed into a heated air flow, a method in which toner particles are subjected to application of repeated mechanical force employing impact in a gas phase, or a method in which a toner is added to a solvent, which does not dissolve the toner, and which is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with common toner.

The variation coefficient of the shape coefficient of the polymerized toner, which is preferably employed in the present invention, is calculated using the formula described below:

$$\text{Variation coefficient}=(S/K)\times 100\ \text{(in percent)}$$

wherein S represents the standard deviation of the shape coefficient of 100 toner particles and K represents the average of the shape coefficient.

The variation coefficient of the shape coefficient is generally not more than 16 percent, and is preferably not more than 14 percent. By adjusting the variation coefficient of the shape coefficient to not more than 16 percent, voids in the transferred toner layer decrease, improving fixability and minimizing the formation of offsetting. Further, the resultant charge amount-distribution narrows, improving image quality.

In order to uniformly control the shape coefficient of toner as well as the variation coefficient of the shape coefficient with minimal fluctuation among production lots, the optimal finishing time of processes may be determined while monitoring the properties of forming toner particles (colored particles) during processes of polymerization, fusion, and shape control of resinous particles (polymer particles).

Monitoring, as described herein, means that measurement units are installed in-line, and process conditions are controlled based on measurement results thereof. Namely, a shape measurement unit, and the like, is installed in-line. For example, in a polymerization method, toner, which is formed employing coalescence or fusion of resinous particles in a water-based media, during processes such as fusion, the shape as well as the particle diameters, is determined while sampling is successively carried out, and the reaction is terminated when the desired shape is noted.

The monitoring methods are not particularly limited, but it is possible to use flow system particle image analyzer FPIA-2000 (manufactured by Toa Iyodenshi Co.). The analyzer is suitable because it is possible to monitor the shape upon carrying out image processing in real time, while passing through a sample composition. Namely, monitoring is always carried out while running the sample composition from the reaction location employing a pump and the like, and the particle shape and the like are measured. The reaction is terminated when the desired shape is obtained.

The number particle distribution as well as the number variation coefficient of the toner of the present invention can be determined, employing Coulter Counter TA-11 or Coulter Multisizer (both manufactured by Coulter Co.). In the present invention, employed was the Coulter Multisizer which was connected to an interface which outputs the particle size distribution (manufactured by Nikkaki), as well as on a personal computer. Employed as the Multisizer was one having a 100 $\mu$m aperture. The volume and the number of particles having a diameter of at least 2 $\mu$m were determined and the size distribution as well as the average particle diameter was calculated. The number particle distribution, as described herein, represents the relative frequency of toner particles with respect to particle diameter, and the number average particle diameter, as described herein, expresses the median diameter in the number particle size distribution.

The number variation coefficient in the number particle distribution of toner is calculated employing the formula described below:

$$\text{Number variation coefficient}=(S/D_n)\times 100 \text{ (in percent)}$$

wherein S represents the standard deviation in the number particle size distribution, and $D_n$ represents the number average particle diameter (in $\mu$m).

The number variation coefficient of the toner of the present invention is usually not more than 27 percent, and is preferably not more than 25 percent. By adjusting the number variation coefficient to not more than 27 percent, voids of the transferred toner layer decrease to improve fixability and to minimize the formation of offsetting. Further, the range of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquids is also effective. In the methods, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets equal to the desired size of the toner. Namely, large oil droplets of the polymerizable monomers are subjected to repeated mechanical shearing employing a homomixer, a homogenizer, and the like to decrease the size of oil droplets to approximately the same size as the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may inevitably need to be employed.

Toner particles without corners, as described herein, refer to those having substantially no projection on which charges are concentrated or which tend to be worn down by stress. Namely, as shown in FIG. 16(*a*), the main axis of toner particle T is designated as L. Circle C, having a radius of L/10, which is positioned in toner T, is rolled along the periphery of toner T, while remaining in contact with the circumference. When it is possible to roll any part of the circle without substantially crossing over the interior circumference of toner T, a toner is designated as "a toner without corners". "Without substantially crossing over the circumference", as described herein, means that there is at most one projection at which any part of the rolled circle crosses over the circumference. Further, "the main axis of a toner particle" as described herein refers to the maximum width of the toner particle when the projection image of the toner particle onto a flat plane is placed between two parallel lines. Incidentally, FIGS. 16(*b*) and 16(*c*) show the projection images of a toner particle with corners.

Toner without corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of the corners was determined. The measurement was carried out for 100 toner particles.

In the toner of the present invention, the ratio of the number of toner particles without corners is generally at least 50 percent, and is preferably at least 70 percent. By adjusting the ratio of the number of toner particles without corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto the developer conveying member, as well as to narrow the charge amount distribution. Further, decreased are toner particles which are readily worn and broken, as well as those which have a portion at which charges are concentrated. Thus, since the charge amount distribution is narrowed, it is possible to stabilize chargeability, resulting in excellent image quality over an extended period of time.

Methods to obtain toner without corners are not particularly limited. For example, as previously described in the method to control the shape coefficient, it is possible to obtain toner without corners by employing a method in which toner particles are sprayed into a heated air flow, a method in which toner particles are subjected to application of repeated mechanical force, employing impact force in a gas phase, or a method in which a toner is added to a solvent which does not dissolve the toner, and which is then subjected to application of revolving current.

Further, in a polymerized toner which is formed by coalescence or fusing resinous particles, during the fusion terminating stage, the fused particle surface is markedly uneven and has not been smoothed. However, by optimizing conditions such as the temperature, the rotation frequency of stirring blades, the stirring time, and the like, during the shape controlling process, it is possible to prepare toner particles without corner. These conditions vary depending on the physical properties of the resinous particles. For example, by setting the temperature higher than the glass transition point of the resinous particles, as well as employing a higher rotation frequency, the surface is smoothed. Thus it is possible to form toner particles without corners.

The diameter of the toner particles of the present invention is preferably from 3 to 8 $\mu$m in terms of the number average particle diameter. When toner particles are formed employing a polymerization method, it is possible to control the particle diameter utilizing the concentration of coagulants, the added amount of organic solvents, the fusion time, or further, the composition of the polymer itself.

By adjusting the number average particle diameter from 3 to 8 μm, it is possible to decrease the presence of toner and the like which is adhered excessively to the developer conveying member, or exhibits low adhesion, and thus stabilizes developability over an extended period of time. At the same time, improved is the halftone image quality as well as general image quality of fine lines and dots.

The polymerized toner, which is preferably employed in the present invention, is as follows. The diameter of toner particles is designated as D (in μm). In a number based histogram, in which natural logarithm in D is taken as the abscissa and the abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution is narrowed. Thus, by employing the toner in an image forming process, it is possible to assuredly minimize the generation of selective development.

In the present invention, the histogram, which shows the number based particle size distribution, is one in which natural logarithm ln D (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). The histogram is drawn by a particle size distribution analyzing program in a computer through transferring to the computer via the I/O unit particle diameter data of a sample which are measured employing Coulter Multisizer under the conditions described below.

(Measurement Conditions)

(1) Aperture: 100 μm (2) Method for preparing samples: while stirring, an appropriate amount of a surface active agent (a neutral detergent) is added to 50 to 100 ml of an electrolyte, Isoton R-11 (manufactured by Coulter Scientific Japan Co.), and subsequently, 10 to 20 ml of a sample to be measured is added to the resultant mixture. Preparation is then carried out by dispersing the resultant mixture for one minute, employing an ultrasonic homogenizer.

Of methods to control the shape coefficient, the polymerized toner method is preferable since it is simple as well as convenient as a toner production method, and in addition, the surface uniformity is excellent compared to pulverized toner.

It is possible to prepare the toner of the present invention in such a manner that fine polymerized particles are produced employing a suspension polymerizing method, and emulsion polymerization of monomers in a liquid added to an emulsion of necessary additives is carried out, and thereafter, coalescence is carried out by adding organic solvents, coagulants, and the like. Methods are listed in which, during coalescence, preparation is carried out by coalescing upon mixing dispersions of releasing agents, colorants, and the like which are required to constitute a toner, a method in which emulsion polymerization is carried out upon dispersing toner constituting components such as releasing agents, colorants, and the like in monomers, and the like. Coalescence, as described herein, means that a plurality of resinous particles and colorant particles are fused.

Incidentally, the water based medium, as described in the present invention, refers to one in which at least 50 percent water by weight is incorporated.

Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired toner size, employing a homomixer, a homogenizer, and the like. Thereafter, the resultant dispersion is conveyed to a reaction apparatus which utilizes as the stirring mechanism stirring blades described below, and undergoes polymerization reaction upon heating. After completing the reaction, the dispersion stabilizers are removed, filtered, washed, and subsequently dried, whereby a toner is prepared.

Further, listed as a method for preparing the toner may be one in which resinous particles are subjected to coalescence, or fusion, in a water based medium. The method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two types of the dispersion particles of components such as resinous particles, colorants, and the like, or fine particles, comprised of resins, and colorants, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than its glass transition temperature, and then while forming the fused particles, the particle diameter is allowed to gradually grow; when the particle diameter reaches the desired value, particle growth is stopped by adding a relatively large amount of water; the resultant particle surface is smoothed while being further heated and stirred, to control the shape, and the resultant particles which incorporate water, is again heated and dried in a fluid state. Further, herein, organic solvents, which are infinitely soluble in water, may be simultaneously added together with the coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, and vinylidene fluoride; vinyl esters such as vinyl propionate, vinyl acetate, and vinyl benzoate; vinyl ethers such as vinyl methyl ether and vinyl ethyl ether; vinyl ketones such as vinyl methyl ketone, vinyl ethyl ketone, and vinyl hexyl ketone; N-vinyl compounds such as N-vinylcarbazole, N-vinylindole, and N-vinylpyrrolidone; vinyl compounds such as vinylnaphthalene and vinylpyridine; as well as derivatives of acrylic acid or methacrylic acid such as acrylonitrile, methacrylonitrile, and acryl amide. These vinyl based monomers may be employed individually or in combinations.

Further preferably employed as polymerizable monomers, which constitute the resins, are those having an ionic dissociating group in combination, and include, for instance, those having substituents such as a carboxyl group, a sulfonic acid group, and a phosphoric acid group, as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, and 3-chloro-2-acid phosphoxypropyl methacrylate.

Further, it is possible to prepare resins having a cross-linking structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, and neopentyl glycol diacrylate.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxy-cyclohexane)propane, and tris-(t-butylperoxy) triazine; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C., as well as a softening point of 80 to 220° C. The glass transition point is determined employing a differential thermal analysis method, while the softening point can be determined employing an elevated type flow tester. Preferred as these resins are those having a number average molecular weight (Mn) of 1,000 to 100,000, and a weight average molecular weight (Mw) of 2,000 to 100,000, which can be determined employing gel permeation chromatography. Further preferred as resins are those having a molecular weight distribution of Mw/Mn of 1.5 to 100, and is most preferably between 1.8 and 70.

Employed coagulants are not particularly limited, but those selected from metal salts are more suitable. Specifically, listed as univalent metal salts are salts of alkaline metals such as, for example, sodium, potassium, and lithium; listed as bivalent metal salts are salts of alkali earth metals such as, for example, calcium, magnesium, and salts of manganese and copper; and listed as trivalent metal salts are salts of iron and aluminum. Listed as specific salts may be sodium chloride, potassium chloride, lithium chloride, calcium chloride, zinc chloride, copper sulfate, magnesium sulfate, and manganese sulfate. These may also be employed in combination.

These coagulants are preferably added in an amount higher than the critical coagulation concentration. The critical coagulation concentration, as described herein, refers to an index regarding the stability of water based dispersion and concentration at which coagulation occurs through the addition of coagulants. The critical coagulation concentration markedly varies depending on emulsified components as well as the dispersing agents themselves. The critical coagulation concentration is described in, for example, Seizo Okamura, et al., "Kobunshi Kagaku (Polymer Chemistry) 17, 601 (1960) edited by Kobunshi Gakkai, and others. Based on the publication, it is possible to obtain detailed critical coagulation concentration data. Further, as another method, a specified salt is added to a targeted particle dispersion while varying the concentration of the salt; the $\xi$ potential of the resultant dispersion is measured, and the critical coagulation concentration is also obtained as the concentration at which the $\xi$ potential varies.

The acceptable amount of the coagulating agents is an amount of more than the critical coagulation concentration. However, the added amount is preferably at least 1.2 times as much as the critical coagulation concentration, and is more preferably 1.5 times.

The solvents, which are infinitely soluble, as described herein, refer to those which are infinitely soluble in water, and in the present invention, such solvents are selected which do not dissolve the formed resins. Specifically, listed may be alcohols such as methanol, ethanol, propanol, isopropanol, t-butanol, and methoxyethanol, butoxyethanol. Ethanol, propanol, and isopropanol are particularly preferred.

The added amount of the infinitely soluble solvents is preferably from 1 to 100 percent by volume with respect to the polymer containing dispersion to which coagulants are added.

Incidentally, in order to make the shape of particles uniform, it is preferable that colored particles are prepared, and after filtration, the resultant slurry, containing water in an amount of 10 percent by weight with respect to the particles, is subjected to fluid drying. At that time, those having a polar group in the polymer are particularly preferred. For this reason, it is assumed that since existing water somewhat exhibits swelling effects, the uniform shape particularly tends to be made.

The toner of the present invention is comprised of at least resins and colorants. However, if desired, the toner may be comprised of releasing agents, functioning as fixability improving agents, and charge control agents. Further, the toner may be one to which external additives, comprised of fine inorganic particles, and fine organic particles, are added.

Optionally employed as colorants, which are used in the present invention, are carbon black, magnetic materials, dyes, and pigments. Employed as carbon blacks are channel black, furnace black, acetylene black, thermal black, and lamp black. Employed as ferromagnetic materials may be ferromagnetic metals such as iron, nickel, cobalt, and the like, alloys comprising these metals, compounds of ferromagnetic metals such as ferrite and magnetite, alloys which comprise no ferromagnetic metals but exhibit ferromagnetism upon being thermally treated such as Heusler's alloys such as manganese-copper-aluminum, manganese-copper-tin, and the like, and chromium dioxide.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, and the same 60, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants, of which surface has been subjected to treatment employing coupling agents, so that radical polymerization is not hindered.

Further, added as fixability improving agents may be low molecular weight polypropylene (having a number average molecular weight of 1,500 to 9,000) and low molecular weight polyethylene.

Employed as charge control agents may also be various types of those which are known in the art and can be dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof.

Incidentally, it is preferable that the number average primary particle diameter of particles of the charge control agents as well as the fixability improving agents is adjusted to about 10 to about 500 nm in the dispersed state.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of the medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among the particles. By employing the methods, it is possible to control the distribution of shaped toner particles within the range of the present invention. Reaction apparatuses, which are preferably employed in the present invention, will now be described.

Figure 6:
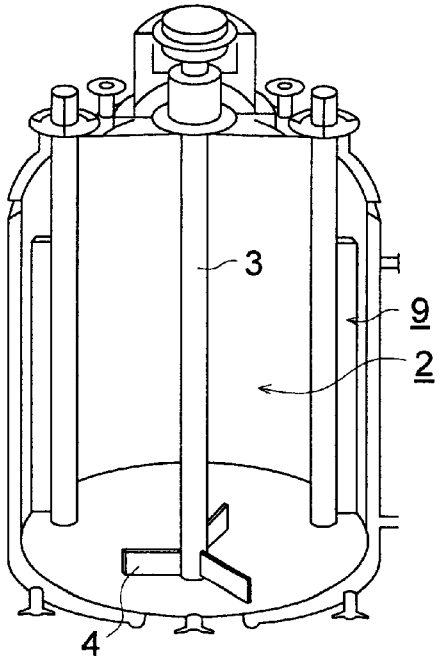
FIG. 6 is a view showing a reaction apparatus in which stirring blades are structured in one level.

FIG. 6 is an explanatory view showing a commonly employed reaction apparatus (a stirring apparatus) in which stirring blades are installed at one level, wherein reference numeral 2 is a stirring tank, 3 is a rotation shaft, 4 are stirring blades, and 9 is a turbulent flow inducing member.

In the suspension polymerization method, it is possible to form a turbulent flow employing specified stirring blades and to readily control the resultant shape of particles. The reason for this phenomenon is not yet clearly understood. When stirring blades 4 are positioned at one level, as shown in FIG. 5, the medium in stirring tank 2 flows only from the bottom part to the upper part along the wall. Due to that, a conventional turbulent flow is commonly formed and stirring efficiency is enhanced by installing turbulent flow forming member 9 on the interior wall surface of stirring tank 2. Though in the stirring apparatus, the turbulent flow is locally formed, the presence of the formed turbulent flow tends to retard the flow of the medium. As a result, shearing against particles decreases to make it almost impossible to control the shape of resultant particles.

Reaction apparatuses provided with stirring blades, which are preferably employed in a suspension polymerization method, will now be described, with reference to the drawings.

Figure 7:
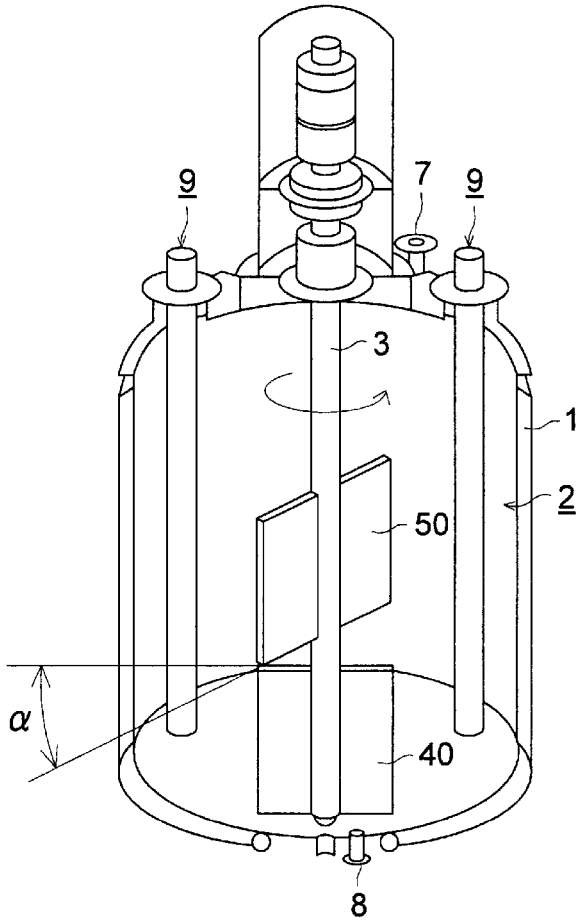
FIG. 7 is a perspective view showing one example of a reaction apparatus fitted with preferably employed stirring blades.
Figure 8:
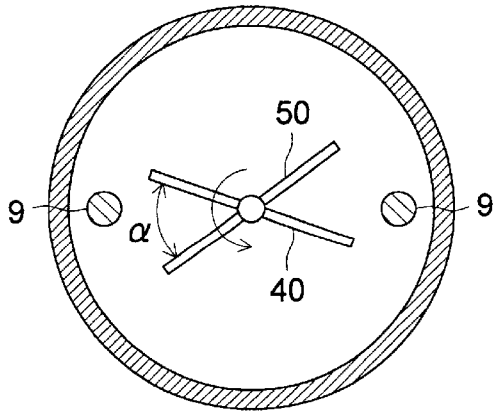
FIG. 8 is a cross-sectional view of the reaction apparatus shown in FIG. 7.

FIGS. 7 and 8 each are respectively perspective views and cross-sectional views, of the reaction apparatus described above. In the reaction apparatus illustrated in FIGS. 7 and 8, rotating shaft 3 is installed vertically at the center in vertical type cylindrical stirring tank 2 of which exterior circumference is equipped with a heat exchange jacket, and the rotating shaft 3 is provided with lower level stirring blades 40 installed near the bottom surface of the stirring tank 40 and upper level stirring blade 50. Upper level stirring blades 50 are arranged with respect to the lower level stirring blade so as to have a crossed axis angle $\alpha$ advanced in the rotation direction. When the toner of the presents invention is prepared, the crossed axis angle $\alpha$ is preferably less than 90 degrees. The lower limit of the crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the constitution as above, it is assumed that, firstly, a medium is stirred employing stirring blades 50 provided at the upper level, and a downward flow is formed. It is also assumed that subsequently, the downward flow formed by upper level stirring blades 50 is accelerated by stirring blades 40 installed at a lower level, and another flow is simultaneously formed by the stirring blades 50 themselves, and as a whole, accelerating the flow. As a result, it is further assumed that since a flow area is formed which has large shearing stress in the turbulent flow, it is possible to control the shape of the resultant toner.

Incidentally, in FIGS. 7 and 8, arrows show the rotation direction, reference numeral 7 is upper material charging inlet, 8 is a lower material charging inlet, and 9 is a turbulent flow forming member which makes stirring more effective.

Figure 15:
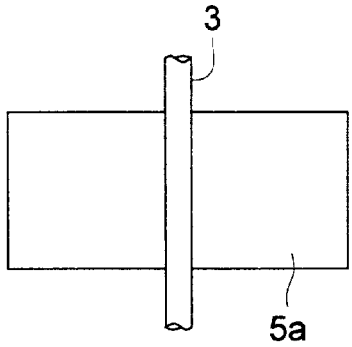
FIGS. 15(*a*) through 15(*d*) are schematic views showing specific examples of blade shape.
Figure 15:
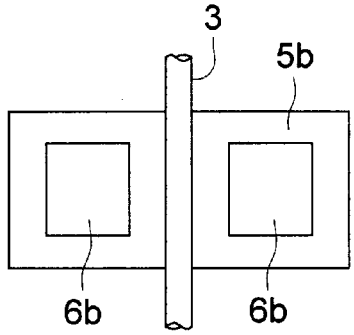
Figure 15:
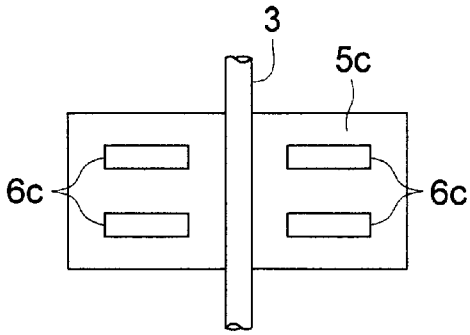
Figure 15:
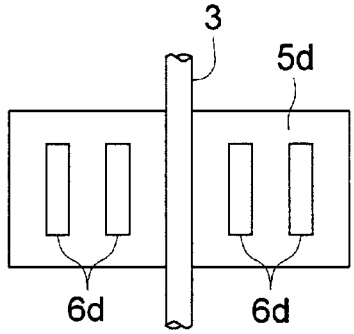

Herein, the shape of the stirring blades is not particularly limited, but employed may be those which are in a square plate shape, blades in which a part is cut away, blades having at least one opening in the central area, a so-called slit, and the like. FIGS. 15(*a*) through 15(*d*) describe specific examples of the shape of the blades. Stirring blade Sa shown in FIG. 15(*a*) has no central opening; stirring blade 5*b* shown in FIG. 15(*b*) has large central opening areas 6*b*; stirring blade 5*c* shown in FIG. 15(*c*) has rectangular openings 6*c* (slits); and stirring blade 5*d* shown in FIG. 15(*d*) has oblong openings 6*d* (slits) shown. Further, when stirring blades of a three-level structure are installed, openings which are formed at the upper level stirring blade and the openings which are installed in the lower level may be different or the same.

FIGS. 9 through 13 each shows a perspective view of a specific example of a reaction apparatus fitted with stirring blades which may be preferably employed. In FIGS. 9 through 13, reference numeral 1 is a heat exchange jacket, 2 is a stirring tank, 3 is a rotation shaft, 7 is an upper material charging inlet, 8 is a lower material charging inlet, and 9 is a turbulent flow forming member.

Figure 9:
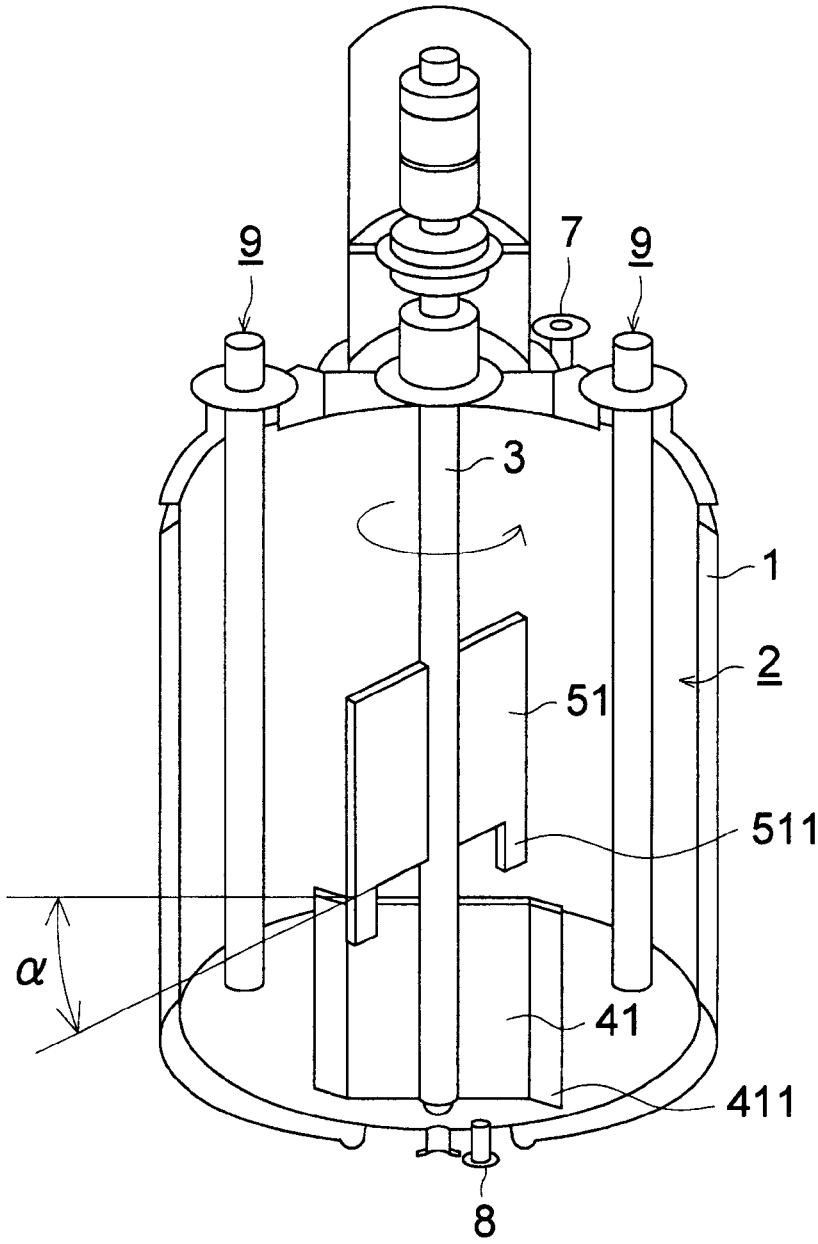
FIG. 9 is a perspective view showing a specific example of a reaction apparatus fitted with one type of preferably employed stirring blades.

In the reaction apparatus shown in FIG. 9, folded parts 411 are formed on stirring blade 42 and fins 511 (projections) are formed on stirring blade 51.

Further, when the folded sections are formed, the folded angle is preferably between 5 and 45 degrees.

Figure 10:
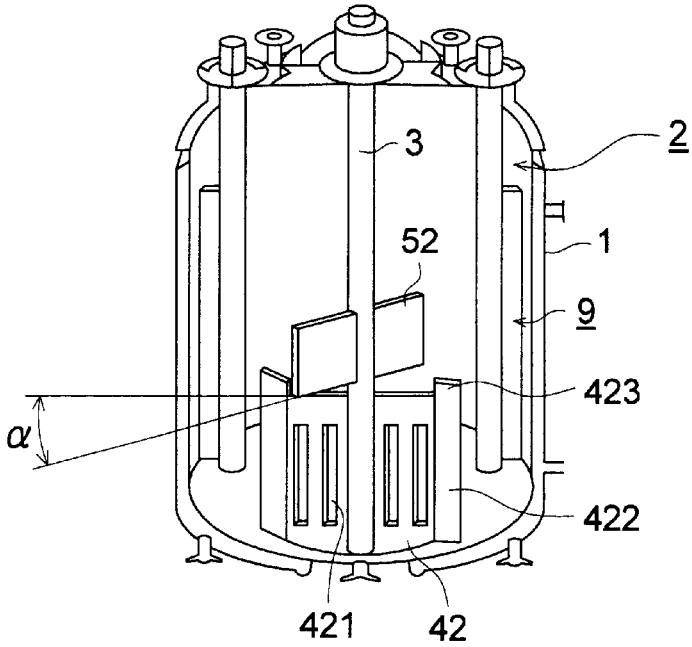
FIG. 10 is a perspective view showing a specific example of a reaction apparatus fitted with another type of preferably employed stirring blades.

In stirring blade 42, which constitutes the reaction apparatus shown in FIG. 10, slits 421, folded sections 422, and fins 423 are formed simultaneously.

Further, stirring blade 52, which constitutes part of the reaction apparatus, has the same shape as stirring blade 50 which constitutes part of the reaction apparatus shown in FIG. 7.

Figure 11:
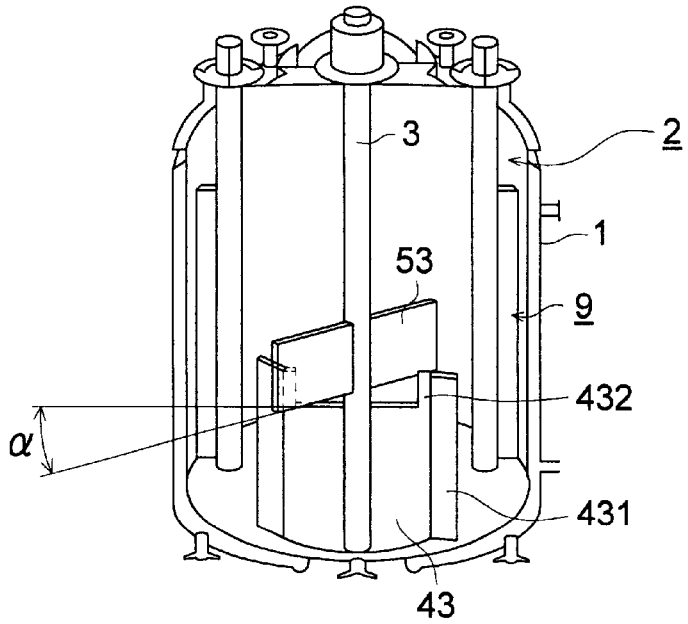
FIG. 11 is a perspective view showing a specific example of a reaction apparatus fitted with still another type of preferably employed stirring blades.

In stirring blade 43, which constitutes part of the reaction apparatus shown in FIG. 11, folded section 431 as well as fin 432 is formed.

Further, stirring blade 53, which constitutes part of the reaction apparatus, has the same shape as stirring blade 50 which constitutes part of the reaction apparatus shown in FIG. 7.

Figure 12:
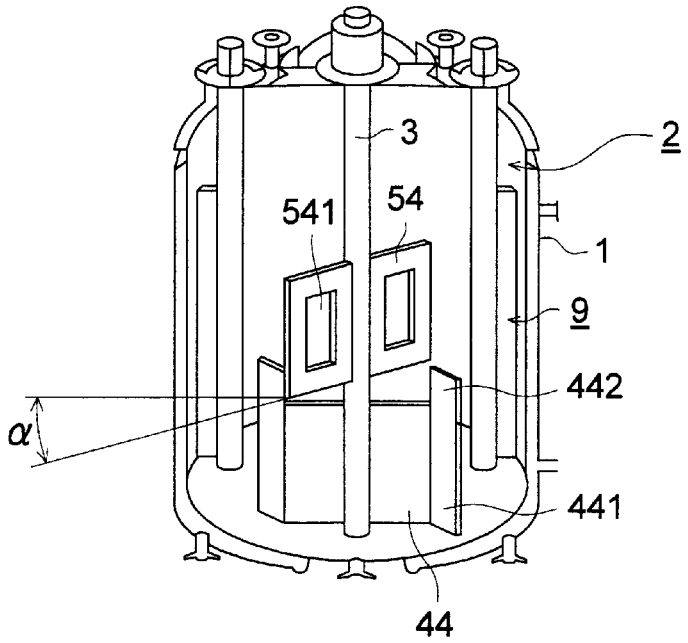
FIG. 12 is a perspective view showing a specific example of a reaction apparatus fitted with yet another type of preferably employed stirring blades.

In stirring blade 44, which constitutes part of the reaction apparatus shown in FIG. 12, folded section 441 as well as fin 442 is formed.

Further, in stirring blade 54, which constitutes part of the reaction apparatus, openings 541 are formed in the center of the blade.

Figure 13:
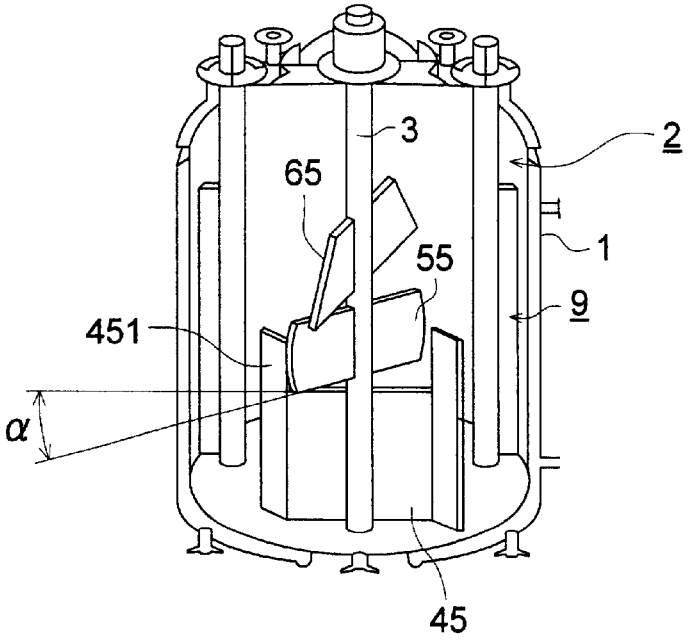
FIG. 13 is a perspective view showing a specific example of a reaction apparatus fitted with still yet another type of preferably employed stirring blades.

In the reaction apparatus shown in FIG. 13, provided are three-level stirring blades comprised of stirring blade 45 (at the lower level), stirring blade 55 (at the middle level), and stirring blades 65 at the top.

Stirring blades having such folded sections, stirring blades which have upward and downward projections (fins), all generate an effective turbulent flow.

Still further, the distance between the upper and the lower stirring blades is not particularly limited, but it is preferable that such a distance is provided between stirring blades. The specific reason is not clearly understood. It is assumed that a flow of the medium is formed through the space, whereby the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum of the height of all stirring blades is between 50 and 100 percent with respect to the liquid height in the stationary state, and is preferably between 60 and 95 percent.

Figure 14:
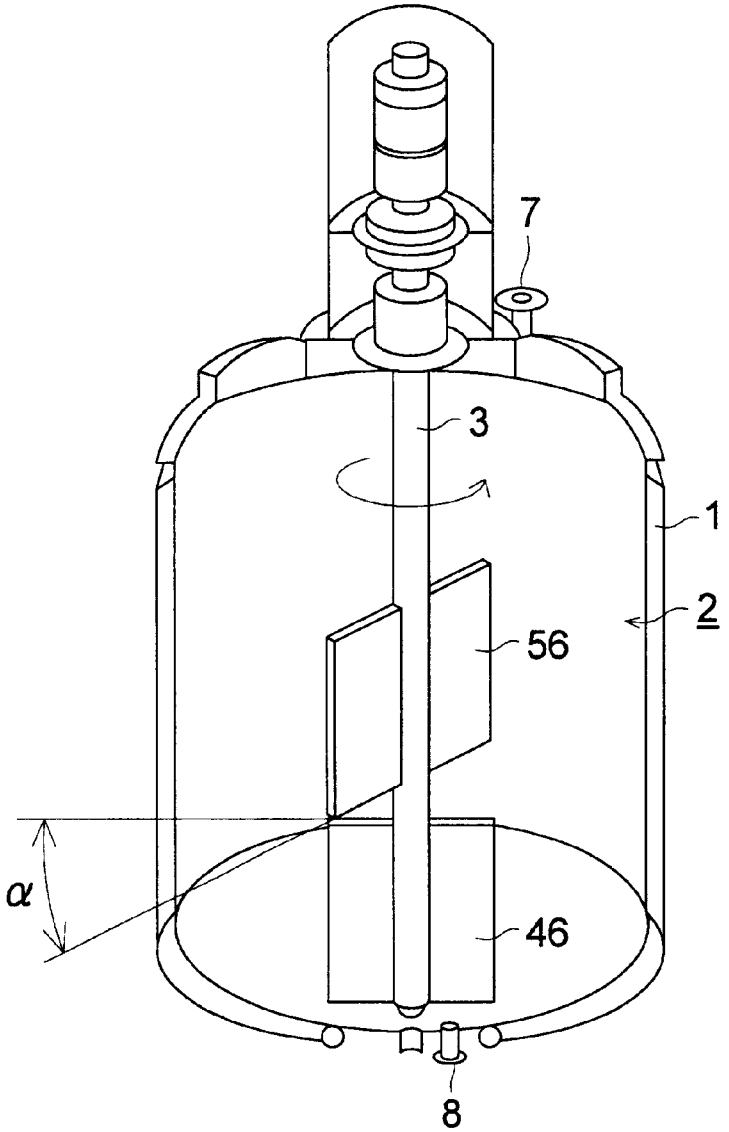
FIG. 14 is a perspective view showing one example of a reaction apparatus which is employed when a laminar flow is formed.

Still further, FIG. 14 shows one example of a reaction apparatus employed when a laminar flow is formed in the suspension polymerization method. The reaction apparatus is characterized in that no turbulent flow forming member (obstacles such as a baffle plate) is provided.

Stirring blade 46, as well as stirring blade 56, which constitutes the reaction apparatus shown in FIG. 14, has the same shape as well as the crossed axis angle $\alpha$ of stirring blade 40, as well as stirring blade 50 which constitutes part of the reaction apparatus shown in FIG. 7. In FIG. 14, reference numeral 1 is a heat exchange jacket, 2 is a stirring tank, 3 is a rotation shaft, 7 is an upper material charging inlet, and 8 is a lower material charging inlet.

Incidentally, apparatuses, which are employed to form a laminar flow, are not limited to the ones shown in FIG. 14.

Further, the shape of the stirring blades, which constitute part of the reaction apparatuses, is not particularly limited as long as they do not form a turbulent flow, but rectangular plates which are formed of a continuous plane are preferred, and may have a curved plane.

On the other hand, in toner which is prepared employing the polymerization method in which resinous particles are coalesced or fused in a water based medium, it is possible to optionally vary the shape distribution of all the toner particles, as well as the shape of the toner particles, by controlling the flow of the medium and the temperature distribution during the fusion process in the reaction vessel, and by further controlling the heating temperature, the frequency of rotation of stirring, as well as the time during the shape controlling process after fusion.

Namely, in a toner which is prepared employing the polymerization method in which resinous particles are coalesced or fused, it is possible to form toner which has the specified shape coefficient and uniform distribution by controlling the temperature, the frequency of rotation, and the time during the fusion process, as well as the shape controlling process, employing the stirring blade and the stirring tank which are capable of forming a laminar flow in the reaction vessel, as well as forming the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the production of toner employing the polymerization method in which resinous particles are coalesced or fused, can be the same stirring blades and stirring tank which are employed in the suspension polymerization in which the laminar flow is formed, and for example, it is possible to employ the apparatus shown in FIG. 13. The apparatus is characterized in that obstacles such as a baffle plate and the like, which forms a turbulent flow, is not provided. It is preferable that in the same manner as the stirring blades employed in the aforementioned suspension polymerization method, the stirring blades are constituted at multiple levels in which the upper stirring blade is arranged so as to have a crossed axis angle $\alpha$ in advance in the rotation direction with respect to the lower stirring blade.

Employed as the stirring blades may be the same blades which are used to form a laminar flow in the aforesaid suspension polymerization method. Stirring blade types are not particularly limited as long as a turbulent flow is not formed, but those comprised of a rectangular plate as shown in FIG. 15(*a*), which are formed of a continuous flat plane are preferable, and those having a curved plane may also be employed.

Further, the toner of the present invention is capable of exhibiting more desired effects when employed after adding fine particles such as fine inorganic or fine organic particles, as external additives. The reason is understood to be as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of the hydrophobic treatment is not particularly limited, but the degree is preferably between 40 and 95 in terms of the methanol wettability. The methanol wettability, as described herein, refers to wettability for methanol. The methanol wettability is determined as follows: in a beaker having an inner capacity of 200 ml, 0.2 g of fine inorganic particles to be measured is weighed and added to 50 ml of distilled water. Methanol is then gradually dripped, while stirring, from a burette whose outlet is immersed in the liquid, until the entire fine inorganic particles are wetted. When the volume of methanol, which is necessary for completely wetting the fine inorganic particles, is represented by "a" ml, the degree of hydrophobicity is calculated based on the formula described below:

$$\text{Degree of hydrophobicity}=[a/(a+50)]\times 100$$

The added amount of the external additives is generally from 0.1 and 5.0 percent by weight with respect to the toner, and is preferably from 0.5 to 4.0 percent. Further, external additives may be employed in combinations of various types.

Employed as external additives which are used in the present invention may be fatty acid metal salts. Cited as fatty acids and salts thereof are long chain fatty acids such as undecylic acid, lauric acid, tridecyl acid, dodecyl acid, myristic acid, palmitic acid, pentadecylic acid, stearic acid, heptadecylic acid, arachic acid, montanic acid, oleic acid, linoleic acid, arachidonic acid, as well as their salts of metals such as zinc, iron, magnesium, aluminum, calcium, sodium, lithium and the like. In the present invention, zinc stearate is particularly preferable.

A double component developer is prepared by mixing a toner with a carrier. The concentration of the toner in the developer is to be from 2 to 10 percent by weight, and the resultant developer is employed.

Development methods according to the present invention are not particularly limited. A contact development method may be employed in which development is carried out in such a manner that the photoreceptor surface comes into contact with the developer layer, and alternatively a non-contact development method may also be employed in which the photoreceptor surface and the developer layer are maintained in a non-contact state, and development is carried out by allowing the toner to jump into the space between the photoreceptor surface and the developer layer, employing means such as an alternating electrical field.

EXAMPLES

The present invention will now be detailed with reference to examples. However, the embodiments of the present invention are not limited to these examples. In the following description, "parts" is "parts by weight".

The photoreceptors described below were prepared as those employed in the present invention.

(Production of Photoreceptor P1)

Charged into a solvent mixture consisting of 900 ml of methanol and 100 ml of butanol were 30 g of polyamide resin Amilan CM-8000 (manufactured by Toray Co.), which were dissolved at 50° C. The resulting solution was applied onto an electroconductive cylindrical aluminum support having an outer diameter of 80 mm and a length of 360 mm, whereby a 0.5 $\mu$m thick interlayer was prepared.

Subsequently, 10 g of silicone resin KR-5240 (manufactured by Shin-Etsu Kagaku Kogyo Co.) were dissolved in 1,000 ml of t-butyl acetate, and 10 g of Y-TiOPc (described in FIG. 1 of Japanese Patent Publication Open to Public Inspection No. 64-17066) were then added to the resulting solution. Subsequently, the resulting mixture was dispersed for 20 hours, employing a sand mill, whereby a charge generating layer coating composition was prepared. The coating composition was applied onto the interlayer, whereby a 0.3 $\mu$m thick charge generating layer was prepared.

Subsequently, 150 g of CTM (T-1: N-(4-methylphenyl)-N-{4-(β-phenylstyryl)phenyl}-p-toluidine) and 200 g of polycarbonate resin TS-2050 (manufactured by Teijin Kasei Co., Ltd.), having a viscosity average molecular weight of 50,000, were dissolved in 1,000 ml of 1,2-dichloroethane, whereby a charge transport coating composition was obtained. The coating composition was applied onto the charge generating layer, employing a circular slide hopper, and subsequently dried at 100° C. for one hour to form a 22 $\mu$m thick charge transport layer. As above, Photoreceptor P1 was prepared which was comprised of the interlayer, the charge generating layer, and the charge transport layer.

(Production of Photoreceptor P2)

Applied onto the surface of the charge transport layer of Photoreceptor P1 obtained in Photoreceptor P1 Production Example, was a coating composition prepared by dissolving 30 g of CTM T-1 and 50 g of polycarbonate resin Upiron Z-800 (manufactured by Mitsubishi Gas Kagaku Co.), having a viscosity average molecular weight of 80,000, in 1,000 ml of 1,2-dichloroethane, employing a circular slide hopper, and subsequently, dried at 100° C. for one hour, whereby a 5 mm thick overcoat layer was formed, as Photoreceptor P-2.

Toners, which were employed in the present invention, were then prepared.

(Production of Toners T1 and T2 (Example of Emulsion Polymerization Method))

While stirring, added to 10.0 liters of pure water was 0.90 kg of sodium n-dodecylsulfate, and the resulting mixture was dissolved. Gradually added to the resulting solution were 1.20 kg of Regal 330R (carbon black manufactured by Cabot Corp.). The resulting mixture was well stirred for one hour, and thereafter, was continuously dispersed for 20 hours employing a sand grinder (a medium type homogenizer). The resulting dispersion was designated as "Colorant Dispersion 1". A solution comprised of 0.055 kg of sodium dodecylbenzenesulfonate and 4.0 L of deionized water was designated as "Anionic Surface Active Agent Solution A".

A solution comprised of 0.014 g of a nonylphenolpolyethylene oxide 10-mole addition product and 4.0 L of deionized water was designated as "Nonionic Surface Active Agent Solution B". A solution prepared by dissolving 223.8 g of potassium persulfate in 12.0 L of deionized water was designated as "Initiator Solution C".

Charged into a 100 L GL (glass lined) reaction vessel fitted with a thermal sensor were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent A", and the total amount of "Nonionic Surface Active Agent Solution B", and the resulting mixture was stirred. Subsequently, 44.0 L of deionized water were added.

When the resulting mixture reached 75° C., the total amount of "Initiator Solution C" was added. Thereafter, while maintaining the resulting mixture at 75±1° C., a mixture consisting of 12.1 kg of styrene, 2.88 kg of n-butyl acrylate, 1.04 kg of methacrylic acid, and 548 g of t-dodecylmercaptan was added dropwise. After the dropwise addition, the resulting mixture was heated to 80±1° C. and stirred for 6 hours while maintaining the temperature. Subsequently, the temperature was lowered to no more than 40° C. and stirring was terminated. The resulting products were filtered employing a pole filter and the resulting filtrate was designated as "Latex (1)-A".

Incidentally, the resinous particles in the Latex (1)-A exhibited a glass transition temperature of 57° C. and a softening point of 121° C., a weight average molecular weight of 12,700 regarding the molecular weight distribution, and a weight average particle diameter of 120 nm.

Further, a solution prepared by dissolving 0.055 kg of sodium dodecylbenzenesulfonate in 4.0 L of deionized water was designated as "Anionic Surface Active Agent Solution D". Further, a solution prepared by dissolving 0.014 kg of a nonylphenolpolyethylene oxide 10 M addition product in 4.0 L of deionized water was designated as "Nonionic Surface Active Agent Solution E".

A solution prepared by dissolving 200.7 g of potassium persulfate (manufactured by Kanto Kagaku Co.) in 12.0 L of deionized water was designated as "Initiator Solution F".

Charged into a 100 L GL reaction vessel, fitted with a thermal sensor, a cooling pipe, a nitrogen gas inlet, and a comb-shaped baffle, were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent D", and the total amount of "Nonionic Surface Active Agent Solution E", and the resulting mixture was stirred. Subsequently, 44.0 L of deionized water were added. When the heated resulting mixture reached 70° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added dropwise. After the dropwise addition, the resulting mixture was maintained at 72±2° C. and stirred for 6 hours while maintaining the temperature. Subsequently, the temperature was raised to 80±2° C., and stirring was carried out for 12 more hours while controlling the temperature within the range. The temperature was then lowered to no more than 40° C., and stirring was terminated. The resulting products were filtered employing a pole filter and the resulting filtrate was designated as "Latex (1)-B".

The resinous particles in the Latex (1)-B exhibited a glass transition temperature of 58° C. and a softening point of 132° C., a weight average molecular weight of 245,000 regarding the molecular weight distribution, and a weight average particle diameter of 110 nm.

A solution prepared by dissolving 5.36 g of sodium chloride as the salting-out agent in 20.0 L of deionized water was designated as "Sodium Chloride Solution G".

A solution prepared by dissolving 1.00 g of a fluorine based nonionic surface active agent in 1.00 L of deionized water was designated as "Nonionic Surface Active Agent Solution H".

Charged into a 100 L SUS reaction vessel (the reaction apparatus constituted as shown in FIG. 14, having a crossed axes angle $\alpha$ of 20 degrees), fitted with a thermal sensor, a cooling pipe, a nitrogen gas inlet, a particle diameter and shape monitoring unit, were 20.0 kg of Latex (1)-A and 5.2 kg of Latex (1)-B as prepared above, 0.4 kg of a colorant dispersion, and 20.0 kg of deionized water, and the resulting mixture was stirred. Subsequently, the mixture was heated to 40° C., and Sodium Chloride Solution G and 6.00 kg of isopropanol (manufactured by Kanto Kagaku Co.), and Nonionic Surface Active Agent Solution H were added in the order. Thereafter, the resulting mixture was put aside for 10 minutes, and then heated to 85° C. over a period of 60 minutes. While being heated at 85±2° C. for the period of from 0.5 to 3 hours while stirring, the mixture was subjected to salting-out/fusion so that the particle diameter increased. Subsequently, the increase in the particle diameter was terminated by the addition of 2.1 L of pure water.

Charged into a 5 L reaction vessel (the reaction apparatus constituted as shown in FIG. 14, having a crossed axes angle $\alpha$ of 20 degrees), fitted with a thermal sensor, a cooling pipe, and a particle diameter and shape monitoring unit, were 5.0 kg of the coalesced particle dispersion as prepared above, and while stirring, the dispersion was heated at 85±2° C. for a period of 0.5 to 15 hours so as to control the particle shape. Thereafter, the resulting dispersion was cooled to no more than 40° C. and stirring was terminated. Subsequently, while employing a centrifuge, classification was carried out in a liquid medium utilizing a centrifugal sedimentation method, and filtration was carried out employing a 45 $\mu$m sieve. The resulting filtrate was designated as Coalesced Liquid Medium (1). Subsequently, wet cake-like non-spherical particles were collected from the Coalesced Liquid Medium (1) through filtration employing a glass filter, and then washed with deionized water.

The resulting non-spherical particles were dried at an air intake temperature of 60° C., employing a flash jet dryer, and subsequently dried at 60° C. employing a fluidized layer dryer. Externally added to 100 parts by weight of the obtained colored particles were 1 part by weight of fine silica particles and 0.1 part by weight of zinc stearate, and the resulting mixture was blended employing a Henschel mixer, whereby toners shown in the table below were obtained which were prepared employing the emulsion polymerization coalescence method. Toners T1 and T2, shown in Table 1, were obtained by controlling the shape as well as the variation coefficient of the shape coefficient through controlling the rotation frequency of the stirrer as well as the heating time during the salting-out/fusion stage and the monitoring of the shape controlling process, and further regulating the particle diameter and the variation coefficient of the size distribution.

(Production of Toner T3 (Example of Suspension Polymerization Method))

A mixture consisting of 165 g of styrene, 35 g of n-butyl acrylate, 10 g of carbon black, 2 g of di-t-butylsalicylic acid metal compound, 8 g of a styrene-methacrylic acid copolymer, and 20 g of paraffin wax (having an mp of 70° C.) was heated to 60° C., and uniformly dissolve-dispersed at 12,000 rpm employing a TK Homomixer (Tokushukika Kogyo Co.). Added to the resulting dispersion were 10 g of 2,2'-azobis(2,4-valeronitile) as the polymerization initiator and dissolved to prepare a polymerizable monomer composition. Subsequently, 450 g of 0.1 M sodium phosphate were added to 710 g of deionized water, and 68 g of 1.0 M calcium chloride were gradually added while stirring at 13,000 rpm, employing a TK Homomixer, whereby a dispersion, in which tricalcium phosphate was dispersed, was prepared. The polymerizable monomer composition was added to the dispersion and stirred at 10,000 rpm for 20 minutes employing a TK Homomixer, whereby the polymerizable monomer composition was granulated. Thereafter, the resulting composition underwent reaction at a temperature of 75 to 95° C. for a period of 5 to 15 hours, employing a reaction apparatus (having a crossed axes angle $\alpha$ of 45 degrees) in which stirring blades were constituted as shown in FIG. 7. Tricalcium phosphate was dissolved employing hydrochloric acid and then removed. Subsequently, while employing a centrifuge, classification was carried out in a liquid medium, utilizing a centrifugal sedimentation method. Thereafter, filtration, washing and drying were carried out. Externally added to 100 parts by weight of the obtained colored particles were 1.0 part by weight of fine silica particles and 0.1 part by weight of zinc stearate, and the resulting mixture was blended employing a Henschel mixer, whereby a toner was obtained which was prepared employing the suspension polymerization method.

Toner T3, shown in Table 1 below, was obtained by controlling the shape as well as the variation coefficient of the shape coefficient through controlling the temperature of the liquid medium, the rotation frequency of the stirrer, and the heating duration while carrying out monitoring during the polymerization, and further by regulating the particle diameter as well as the variation coefficient of the size distribution.

(Preparation of Developers)

Preparation of Developer 1:

Added to 100 parts of the Toner T1 were 0.4 part of hydrophobic silica particles (R805, manufactured by Nippon Aerosil Co.) having an average particle diameter of 12 nm as well as 0.6 part of Titania particles (T805, manufactured by Nippon Aerosil Co.) as the external additives, and the resulting composition was stirred at normal temperature for 10 minutes at a stirring blade circumferential speed of 40 m/second, employing a Henschel mixer, whereby a negatively chargeable toner was obtained. The adhesion ratio of the toner was 45 percent.

The toner was blended with a silicone resin coated ferrite carrier having a volume average particle diameter of 60 $\mu$m, whereby Developer 1 having a toner concentration of 5 percent was prepared.

Preparation of Developers 2 and 3:

Developer 2 was prepared in the same manner as Developer 1, except that Toner T1 was replaced with Toner T2, while Developer 3 was prepared in the same manner as Developer 1, except that Toner T1 was replaced with Toner T3

Example 1

Insufficient residual toner removal, blade curl-under, blade noise, and image unevenness were evaluated employing a digital copier, Konica 7050, manufactured by Konica Corp., basically comprising the image forming process (including processes of corona charging, laser exposure, reversal development, electrostatic transfer, claw separation, and cleaning utilizing a cleaning blade) described in FIG. 1, in which the joined state of the cleaning blade with the supporting member, the damping material adhesion position, the blade contact load, and the contact angle combinations were set as shown in Table 2. During the evaluation, an original document, having equal quarters of a text image at a pixel ratio of 7 percent, a gray scale image, a solid white image, and a solid black image, was continuously copied onto A4 paper sheets for 90 minutes at a rate of 50 sheets/minute at normal temperature and normal humidity (24° C. and 60 percent relative humidity). However, prior to the beginning of the evaluation, in order to allow the cleaning blade to adjust to the photoreceptor, cleaning powder was scattered onto the photoreceptor and the cleaning blade, and the photoreceptor was rotated for 1 minute.

Cleaning blade: hardness of 70 degrees, impact resilience of 60 percent, thickness of 2 mm, free length of 9 mm, length in the photoreceptor axis direction of 340 mm, width of 18 mm

TABLE 1

| Toner No. | Shape Coefficient Ratio of 1.0 to 1.6 (in %) | Shape Coefficient Ratio of 1.2 to 1.6 (in %) | Variation Coefficient of Shape Coefficient (in %) | Ratio of Toner Particles Without Corners (in %) | Number Average Particle Diameter (in $\mu$m) | Variation Coefficient of Particle Number Distribution (in %) | Sum M of $m_1$ and $m_2$ (in %) | Preparation Method |
|---|---|---|---|---|---|---|---|---|
| Toner T1 | 76.6 | 72.0 | 14.9 | 53 | 6.4 | 26.2 | 77.0 | emulsion polymerization coalescence |
| Toner T2 | 75.7 | 70.6 | 15.3 | 58 | 6.3 | 25.8 | 78.1 | emulsion polymerization coalescence |
| Toner T3 | 89.5 | 76.9 | 14.8 | 61 | 8.9 | 26.6 | 77.8 | suspension polymerization |

S2: 6,120 $mm^2$

Damping material: Scotch Damp SJ2015X-Type 110 (manufactured by Sumitomo 3M Limited.)(having a maximum loss factor $\eta_{max}$ of approximately 1.2)

Joint width of cleaning blade with support: 9 mm at in parallel joint and 2 mm at end to end joint in the case of FIG. 3(*g*)

Photoreceptor: P1

Developer: 1 (Toner 1)

Other cleaning conditions are:

Cleaning blade contact angle: described in Table 2

Cleaning blade load (in M/m): described in Table 2

Other evaluation conditions are:

In addition, evaluation conditions other than those set in Konica 7050 were set as described below.

Charging condition is:

Charging unit: scorotron charging unit in which the initial charge potential was set at −750 V.

Exposure condition is:

The exposure amount was set so as to obtain an exposed section potential of −50 V.

Development conditions are:

DC bias: −550 V

Dsd: 550 μm

Developer layer regulation: edge-cut system

Developer layer thickness: 700 μm

Development sleeve diameter: 40 mm

Transfer conditions are:

Transfer electrode: corona charging system, transfer dummy electric current of 45 μA Cleaning Properties Evaluation (Evaluation Items and Evaluation Criteria)

(1) As for Insufficient Residual Toner Removal:

A: all development toner was removed

B: up to 10 percent development toner was not removed

C: at least 10 percent development toner was not removed.

(2) As for Blade Curl-Under:

A: no blade curl-under occurred

B: partial blade curl-under occurred

C: total blade curl-under occurred.

(3) As for Vibration Amplitude of Cleaning Blade:

The sensor of an acceleration detector NP-3210, manufactured by Ono Sokki Co. was fitted with the supporting member joined with the cleaning blade in parallel, and when the photoreceptor rotates at a constant rate, vibration was recorded for 10 seconds employing the sensor. Output data from the sensor were processed employing Ono Sokki CF6400 4-Path Intelligent FF Analyzer, and the average of amplitude of the vibration was obtained, which was designated as the magnitude (in μm) of vibration of the blade.

Table 2 shows the evaluation results.

TABLE 2

| | 1A | 1B | 1C | 1D | 1E | 1F | 1G |
|---|---|---|---|---|---|---|---|
| Joined State of Cleaning Blade with Supporting Member | in parallel | in parallel | in parallel | in parallel | in parallel | in parallel | in series |
| Damping Material | present | present | present | present | present | none | present |

TABLE 2-continued

| | 1A | 1B | 1C | 1D | 1E | 1F | 1G |
|---|---|---|---|---|---|---|---|
| Adhesion Section | FIG. 3 (a) | FIG. 3 (b) | FIG. 3 (c) | FIG. 3 (d) | FIG. 3 (e) | FIG. 3 (f) | FIG. 3 (g) |
| $S_1$ (in $mm^2$) | 3060 | 3060 | 1850 | 18360 | 30600 | 0 | 680 |
| $S_2$ (in $mm^2$) | 6120 | 6120 | 6120 | 6120 | 6120 | 6120 | 6120 |
| $S_1/S_2$ | 0.5 | 0.5 | 0.3 | 3 | 5 | 0 | 0.11 |
| Cleaning Blade Load (in N/m) | 20 | 30 | 10 | 30 | 20 | 20 | 20 |
| Cleaning Blade Contact Angle θ (in degrees) | 20 | 25 | 15 | 15 | 20 | 20 | 20 |
| Insufficient Residual Toner Removal | A | A | A | A | A | C | C |
| Blade Curl-Under | A | A | A | A | A | C | C |
| Vibration Amplitude (in μm) | 120 | 150 | 170 | 170 | 150 | 250 | 220 |

As can clearly be seen from Table 2, Examples 1A through 1E of the present invention, in which the cleaning blade and the supporting member are adjacently joined in parallel to which the damping material is adhered, exhibit excellent cleaning properties without insufficient residual toner removal as well as blade curl-under, while Examples 1F and 1G beyond the present invention result in greater vibration amplitude than those of the present invention, and result in insufficient residual toner removal as well as blade curl-under.

Example 2

Evaluation was carried out in the same manner as Example 1, except that conditions of the cleaning blade, the damping material, the photoreceptor, the developer, and the like were varied as described below.

Cleaning blade: hardness of 70 degrees, impact resilience of 50 percent, thickness of 2.5 mm, and free length of 5 mm Damping material: Scotch Damp SJ2015X-Type 112 (manufactured by Sumitomo 3M Limited.) (having a maximum loss factor $\eta_{max}$ of approximately 1.0)

Photoreceptor: P2

Developer: 2 (Toner: T2)

Other cleaning conditions are:

Cleaning blade contact angle: described in Table 3

Cleaning blade load (in N/m): described in Table 3

Other conditions were same as Example 1.

Table 3 shows the results.

TABLE 3

| | 2A | 2B | 2C | 2D | 2E | 2F | 2G |
|---|---|---|---|---|---|---|---|
| Joined State of Cleaning Blade with Supporting Member | in parallel | in parallel | in parallel | in parallel | in parallel | in parallel | in series |

TABLE 3-continued

| | 2A | 2B | 2C | 2D | 2E | 2F | 2G |
|---|---|---|---|---|---|---|---|
| Damping Material | present | present | present | present | present | none | present |
| Adhesion Section | FIG. 3 (a) | FIG. 3 (b) | FIG. 3 (c) | FIG. 3 (d) | FIG. 3 (e) | FIG. 3 (f) | FIG. 3 (g) |
| $S_1$ (in $mm^2$) | 3060 | 3060 | 1850 | 18360 | 30600 | 0 | 680 |
| $S_2$ (in $mm^2$) | 6120 | 6120 | 6120 | 6120 | 6120 | 6120 | 6120 |
| $S_1/S_2$ | 0.5 | 0.5 | 0.3 | 3 | 5 | 0 | 0.11 |
| Cleaning Blade Load (in N/m) | 20 | 30 | 10 | 30 | 20 | 20 | 20 |
| Cleaning Blade Contact Angle θ (in degrees) | 20 | 25 | 15 | 15 | 20 | 20 | 20 |
| Insufficient Residual Toner Removal | A | A | A | A | A | C | C |
| Blade Curl-Under | A | A | A | A | A | C | B |
| Vibration Amplitude (in μm) | 130 | 160 | 180 | 180 | 160 | 250 | 230 |

As can clearly be seen from Table 3, Examples 2A through 2E of the present invention, in which the cleaning blade and the supporting member are joined in parallel and the damping material is adhered, exhibit excellent cleaning properties without insufficient residual toner removal, as well as blade curl-under, while Examples 1F and 1G, beyond the present invention, result in greater vibration amplitude than those of the present invention and exhibit insufficient residual toner removal as well as blade curl-under.

Example 3

Evaluation was carried out under the same conditions as Example 1, except that the photoreceptor and the developer were replaced with those described below and the type of the damping material were was varied as shown in Table 4.

Photoreceptor: P2

Developer: 2 (Toner: T2)

TABLE 4

| | 3A | 3B | 3C |
|---|---|---|---|
| Joined State of Cleaning Blade with Supporting Member | in parallel | in parallel | in parallel |
| Damping Material | present | present | present |
| Adhesion Section | FIG. 3 (a) | FIG. 3 (a) | FIG. 3 (a) |
| Type of Damping Material | LR-A manufactured by Bridgestone Corp. | VEM 113 manufactured by Sumitomo 3M Limited | LR-V manufactured by Bridgestone Corp. |
| $S_1$ (in $mm^2$) | 3060 | 3060 | 1850 |
| $S_2$ (in $mm^2$) | 6120 | 6120 | 6120 |
| $S_1/S_2$ | 0.5 | 0.5 | 0.5 |
| Cleaning Blade Load (in N/m) | 20 | 20 | 20 |
| Cleaning Blade Contact Angle θ (in degrees) | 15 | 15 | 20 |
| Insufficient Residual Toner Removal | A | A | A |
| Blade Curl-Under | A | A | A |
| Vibration Amplitude (in μm) | 130 | 130 | 140 |

As can clearly be seen from Table 4, Examples 3A through 3C of the present invention, in which the cleaning blade and the supporting member are joined in parallel and the damping material is adhered, exhibit excellent cleaning properties without insufficient residual toner removal and blade curl-under.

Example 4

Evaluation was carried out under the same conditions as 1A of Example 1, except that the viscoelastic properties of the damping material were varied as shown in Table 5. Table 5 shows the evaluation results.

TABLE 5

| | 4A | 4B | 4C | 4D | 4E |
|---|---|---|---|---|---|
| Joined State of Cleaning Blade with Supporting Member | in parellel | in parellel | in parellel | in parellel | in parellel |
| Damping Material | present | present | present | present | present |
| Adhesion Area | FIG. 3 (a) | FIG. 3 (a) | FIG. 3 (a) | FIG. 3 (a) | FIG. 3 (a) |
| Maximum Loss Factor $\eta_{max}$ of Damping Material | 0.3 | 0.5 | 1 | 1.5 | 2 |
| Dynamic Shearing Elasticity Modulus $G^1$ (in kpa) | $6.9 \times 10^4$ | $1.38 \times 10^4$ | $6.9 \times 10^3$ | $4.83 \times 10^3$ | $3.45 \times 10^3$ |
| Cleaning Blade Load (in N/m) | 20 | 30 | 10 | 30 | 20 |
| Cleaning Blade Contact Angle θ (in degrees) | 20 | 25 | 15 | 15 | 20 |
| Insufficient Residual Toner Removal | B | A | A | A | A |
| Blade Curl-Under | A | A | A | A | A |
| Vibration Amplitude (in μm) | 200 | 180 | 130 | 150 | 190 |

As can clearly be seen from Table 5, samples having a maximum loss factor $\eta_{max}$ of the damping material in the range of 0.3 to 2.0 exhibit excellent cleaning properties without insufficient residual toner removal and blade curl-under and also result in large damping effects for vibration amplitude, and the damping materials, having a maximum loss factor $\eta_{max}$ in the range of 0.5 to 1.5, exhibit large effects.

Example 5

Evaluation was carried out in the same manner as Example 1, except that damping material adhesion area $S_1$ and cleaning blade area $S_2$ were further greatly varied as described in Table 6. Table 6 shows the evaluation results.

TABLE 6

| | 5A | 5B | 5C | 5D | 5E |
|---|---|---|---|---|---|
| Joined State of Cleaning Blade with Supporting Member | in parellel | in parellel | in parellel | in parellel | in parellel |
| Damping Material | present | present | present | present | present |
| Adhesion Area | FIG. 3 (b) | FIG. 3 (b) | FIG. 3 (a) | FIG. 3 (e) | FIG. 3 (e) |
| $S_1$ (in $mm^2$) | 306 | 1850 | 3060 | 30600 | 73440 |
| $S_2$ (in $mm^2$) | 6120 | 6120 | 6120 | 6120 | 6120 |
| $S_1/S_2$ | 0.05 | 0.3 | 0.5 | 5 | 12 |
| Cleaning Blade Load (in N/m) | 20 | 20 | 20 | 20 | 20 |
| Cleaning Blade Contact Angle θ (in degrees) | 20 | 20 | 20 | 20 | 20 |
| Insufficient Residual Toner Removal | B | A | A | A | A |
| Blade Curl-Under | B | A | A | A | A |
| Vibration Amplitude (in μm) | 200 | 150 | 120 | 150 | 150 |

As can clearly be seen from Table 6, the ratio of $S_1/S_2$ in the range of 0.05 to 12 exclusively results in desired effects, and the ratio in the range of 0.3 to 5 results in markedly desired effects.

As can clearly be seen from the examples above, by employing the toner cleaning devices of the present invention, it is possible to effectively remove the residual toner on the organic photoreceptor without blade curl-under and insufficient residual toner removal.

Figure 17:
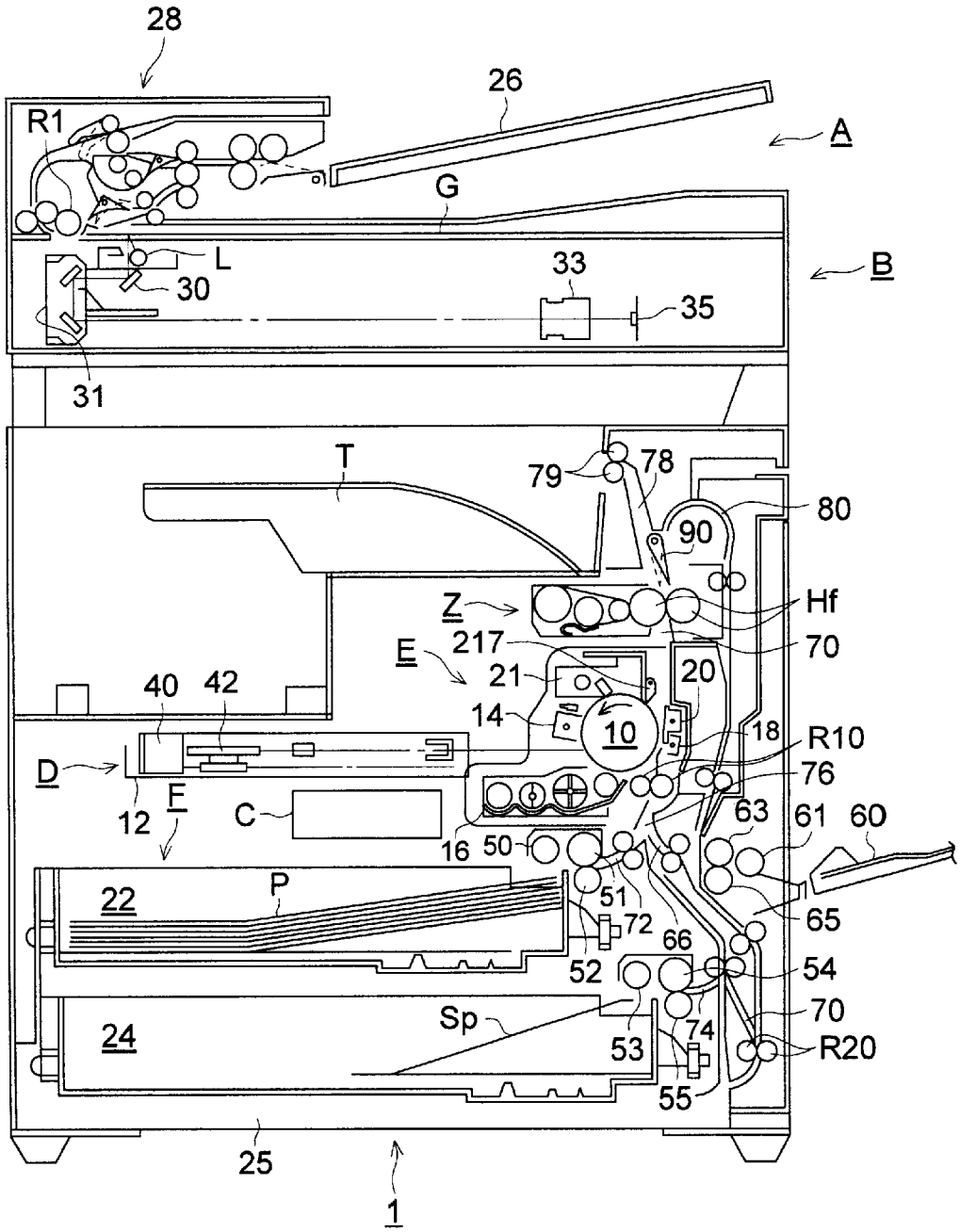
FIG. 17 is a schematic view showing another structure of the whole image forming apparatus of the present invention.

FIG. 17 is a view showing the structure of a digital image forming apparatus (hereinafter occasionally referred simply to as an image forming apparatus), which is applied to the present invention.

In FIG. 17, image forming apparatus 1 comprises an automatic original document feeding unit (generally referred to as ADF) A, original document image reading section B which reads fed original document images, image controlling substrate which processes read original document images, writing section D comprising writing unit 12 which writes images, based on data after image processing on cylindrical photoreceptor (hereinafter occasionally referred to simply as a photoreceptor) 10 as the image bearing body, image forming section E comprising image forming means comprised of cylindrical photoreceptor 10, and charging electrode 14 around the photoreceptor, development unit 16 as a development means comprised of a magnetic brush type development unit, transfer electrode 18, separation electrode 20, toner cleaning device 21 as the cleaning means, and housing section F for paper feeding tray 22 and 24 to store recording paper P.

The automatic original document feeding unit A comprises as the main element original document feeding and processing section 28 comprising original document placing stand 26, a group of rollers including roller R1, and switching means and the like (no reference symbol) which suitably switch the paths of original document movement.

The original document reading section B is under glass platen G, and is comprised of two mirror units 30 and 31 capable of moving back and forth while maintaining the optical path length, fixed imaging lens (hereinafter simply referred to as a lens) 33, linear imaging element (hereinafter simply referred to as CCD) 25, and the like. The writing section D is comprised of laser beam source 40, polygonal mirror (being a polarizing unit) 42, and the like.

Viewing from the moving direction of transfer paper P as the transfer material, R10, shown on the preceding side of transfer electrode 18, is a registration roller, and H, on the downstream side of separating electrode 20, is a fixing unit.

In the present embodiment, fixing unit H, as the fixing means, is comprised of a roller comprising a heating source in its interior and a pressure contact roller which rotates while in pressure contact with the roller.

Further, Z is a cleaning means for fixing unit H which comprises, as the main component, a cleaning web provided so as to be windable.

One of the original documents (not shown) placed on original document placing stand 26 is conveyed by the original document feeding and processing section 28, and is exposed employing exposure means L while passing the bottom of roller R1.

Reflection light from the original document is imaged on CCD 35 through mirror units 30 and 31, and lens 33, and then read.

Image information, which is read by original document image reading section B, is processed by an image processing means, coded, and stored in the memory provided on image controlling substrate C.

Further, image data are retrieved in response to image formation, and in accordance with the image data, laser beam source 40 in writing section D is driven, whereby exposure is carried out onto cylindrical photoreceptor 10.

Prior to the exposure, cylindrical photoreceptor 10, which rotates in the arrowed direction (being the counterclockwise direction), is provided with specified surface electrical potential utilizing corona discharge action of charging electrode 14, and the electrical potential at the exposed area decreases in response to the exposure amount. As a result, an electrostatic latent image in response to image data is formed on cylindrical photoreceptor 10.

The electrostatic latent image is subjected to reversal development utilizing development unit 16 so as to form a visible image (being a toner image). On the other hand, before the leading edge of the toner image on cylindrical photoreceptor 10 reaches the transfer zone, for example, one sheet of recording paper P in paper feeding tray 22 is feed-conveyed and reaches registration roller R10, whereby the leading edge is aligned.

Recording paper P is conveyed to the transfer zone by registration roller R10 which initiates synchronized rotation so as to be superposed with the toner image, namely the image zone on cylindrical photoreceptor 10.

In the transfer zone, the toner image on cylindrical photoreceptor 10 is transferred onto recording paper P while energized by transfer electrode 18, and subsequently, the recording paper P is separated from cylindrical photoreceptor 10 while energized by separation electrode 20.

Thereafter, the toner image is melt-fixed on recording paper P through application of pressure and heat to fixing unit H. Subsequently, the recording paper P is ejected onto ejection paper tray T via ejection paper path 78 and paper ejection roller 79.

Reference symbol Sp in paper feeding tray 24 represents a moving plate in which the free edge is constantly presses upward by pressing means (not shown) such as coil springs. As a result, the uppermost sheet is brought into contact with the ejection roller described below.

Paper feeding tray 22 is constituted in the same manner as described above.

In the present embodiment, paper feeding trays 22 and 24 are arranged at two levels in the vertical direction. However, three or more paper feeding trays may be provided.

Space section 25 is formed between the bottom section (referring to the bottom wall) of paper feed tray 24 arranged at the lower level (since, in the present embodiment, two paper feed trays are stacked, the lower level is used, however, it generally refers to the lowest level) and the bottom surface of the apparatus body.

The space section 25 is utilized at the embodiment (or mode) in which images are formed on both surfaces of recording paper P, and contributes to achieving reversal of the surface of the recording paper in cooperation with second conveying path 80 (described below) for reversing the surface of the recording paper.

Each of numerals 50 and 53, shown at the upper section of each edge (viewing from the paper feed direction, corresponding to the leading edge of housed recording paper P) of paper feed trays 22 and 24, is a paper feed means (hereinafter referred to as a feed-out roller) comprised of a roller. Each of numerals 51 and 54 is a feed roller, while numerals 52 and 55 are multiple sheet-feed prevention rollers.

Feed-out rollers 50 and 53, and feed roller 51 and 54 are combined as a unit, which is structured so as to be readily detachable from the drive shaft connected to the drive source provided on the apparatus body side or the attaching means provided in the paper feed section.

Further, multiple sheet-feed prevention rollers 52 and 55 are also combined as a unit, and are structured so as to be readily detachable from the fixing member provided in the fixing section of the apparatus body.

Numeral 60 is a manual paper feed tray of the manual paper feed section and is structured so that it is possible to open and close it with respect to the body side wall of image forming apparatus 1 utilizing its lower end as the fulcrum.

Numeral 61 is a feed-out roller comprised of a roller to feed out the recording paper placed on manual paper feed tray 60 after image formation. Numeral 63 is a feed roller provided downstream of the feed-out roller 61. Numeral 65, which is brought into pressure contact with feed roller 63, is a multiple sheet-feed prevention roller to prevent multiple sheet-feeding of recording paper P, and is structured substantially in the same manner as the paper feed trays 22 and 24.

Numeral 66 is the conveying path of recording sheet P delivered from manual paper feed tray 60, and passes through the merging section described below, via a pair of conveying rollers shown on the close right side of feed roller 63.

Numeral 70 is the first conveying path to perform image formation via transfer onto recording sheet P. Viewed from the movement direction of the recording paper which is suitably fed out from the paper feed tray, the path extends from the lower to the upper.

Numeral 72 is the paper feed path for recording paper placed in upper paper feed tray 22, and numeral 74 is the paper feed path for recording paper placed in lower paper feed tray 24. Numeral 76 is a merging section (being a part of the first conveying path 70) at which recording paper P sent from both trays 22 and 24 merges.

Numeral 78 is the paper ejection path to eject specified image formed recording paper onto paper ejection tray T.

Numeral 80 is the second conveying path for recording paper which is subjected to surface reversal to form images on both of its surfaces and passes through the first conveying path at the upper part of the apparatus shown in FIG. 17.

Viewed from the movement direction of the recording paper, second conveying path 80 extends from the upper to the lower.

Further, the lower end of second conveying path 80 is structured to be a conveying path extending approximately to the perpendicular direction and the lower end is structured so as to extend to the side lower than the paper feed section of lower paper feed tray 24 and to connect (pass through) to first conveying path 70.

As can be noticed from the above, first conveying path 70 and second conveying path 80 form a long loop in the longitudinal direction on one side wall of the apparatus main body.

At the merging section of first conveying path 70 and second conveying path 80, conveying means R20 (also employed as switch-back rollers) is comprised of a pair of reversible rotating rollers.

Since recording paper P is not continuously conveyed from second conveying path 80 to first conveying path 70, the merging section may be called a diverging section which classifies recording paper to both conveying paths.

Below switchback roller R20, a path, which passes through space section 25, is provided. During reversing of the surface of recording sheet P, the second conveying path 80 is employed so as to directing conveyed recording paper P to second conveying path 80.

When recording paper P, conveyed through second conveying path 80, is conveyed toward the direction of space section 25, an image forming process is constituted so that the final end of the recording paper P is grasped by switch-back rollers R20. As a result, a part of the recording sheet is temporarily housed in space section 25.

Numeral 90 controls a branching guide (upper side) so that recording paper P, on which an image is formed on the first surface, is directed to paper ejection path 78 or to second conveying path 80.

In other words, control is carried out based on the mode (the mode in which an image is formed only on one side of the recording paper or the mode in which images are formed on both surfaces of the recording sheet), whereby it is possible to switch the recording paper conveying path.

When images are formed employing image forming section E, constituted as above, the surface of cylindrical photoreceptor 10 is charged employing discharge action of charging electrode 14 along with the rotation of the cylindrical photoreceptor 10. Subsequently, an image is written in writing section D, whereby an electrostatic latent image is formed. The resulting electrostatic latent image is developed employing development unit 16, whereby a toner image is formed. Employing a transfer electrode, the resulting toner image is transferred onto recording paper P which has been fed from paper feed trays 22 or 24, or manual paper feed tray 60, and subsequently recording paper P is separated employing separation electrode 20, fixed employing fixing unit H, and ejected onto paper ejection tray T.

Figure 18:
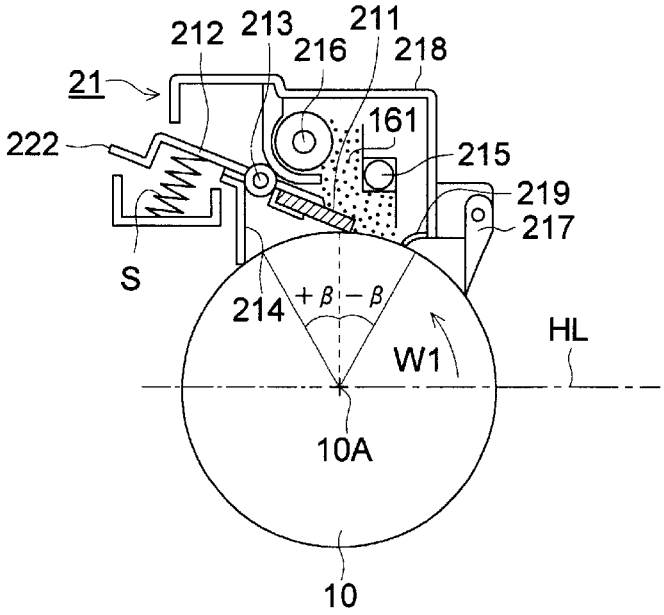
FIG. 18 is a view showing another structure of a toner cleaning device employing the cleaning blade of the present invention.

FIG. 18 is a cross-sectional view of a toner cleaning device employed in the image forming apparatus of the present invention.

In FIG. 18, cylindrical photoreceptor 10 is arranged in the image forming apparatus so that the cylinder's central axis is set to be approximately horizontal. Approximately horizontal, as described herein, refers to an angle of ±10 degrees between the cylinder center's axis and the horizontal plane. Toner cleaning device 21 is provided above the cylindrical photoreceptor 10. Toner cleaning device 21 is provided above the cylindrical photoreceptor 10. As shown in FIG. 18, the toner cleaning device 21 is provided above horizontal line HL passing through rotation center 10A of the cylindrical photoreceptor 10. When the upper direction perpendicular to the central axis of the cylindrical photoreceptor 10 is designated as being 0 degree, the edge of cleaning blade 211 is brought into pressure contact with the photoreceptor surface at the cylindrical photoreceptor's cylinder center angle β within ±30 degrees, whereby toner on the photoreceptor is removed.

In the side direction of frame body 218 of toner cleaning device 21, sheet-shaped conductive member 219 and separation claw 217 are provided upstream of the cleaning blade, and the sheet-shaped electroconductive member 219 as well as the separation claw 217 comes into contact with the surface of photoreceptor 10.

Further, in the interior of the frame body 218, supporting member 212 is rotatably supported by shaft 213, and the base section of cleaning blade 211 is fixed at one end of the supporting member 212. Other end 222, of supporting member 212, is provided to be exposed to the exterior.

In the operation state of toner cleaning device 21, the end of cleaning blade 211 is brought into pressure contact with cylindrical photoreceptor 10, utilizing the elastic force of spring S provided at the other end of supporting member 211. One end of elastic plate 214 is fixed to supporting member 212 so that the elastic plate is positioned further downstream than shaft 213 with respect to the rotational direction of cylindrical photoreceptor 10, whereby toner scattering is minimized when the toner blade is released from pressure contact. The elastic plate 214 is preferably comprised of polyurethane rubber or polyethylene terephthalate.

Further, in the interior of the frame body 218, toner ejection members 215 and 216 are provided to successively eject residual toner from the interior of frame body 218 to the exterior, when residual toner on cylindrical photoreceptor 10 is removed employing cleaning blade 211 after a toner image is transferred to recording paper P.

Figure 19:
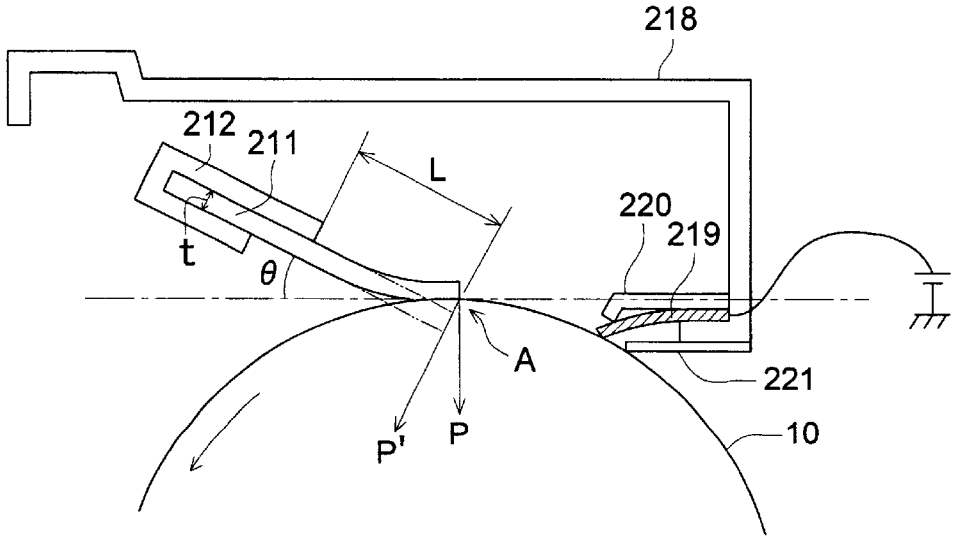
FIG. 19 is a view illustrating the relationship between the cleaning blade of the present invention and the cylindrical organic photoreceptor.

FIG. 19 is a view further detailing the relationship between the cleaning blade and the organic photoreceptor of the present invention.

In FIG. 19, when the upper direction perpendicular to the central axis of cylindrical photoreceptor 10 is to be 0 degree, the edge of cleaning blade 211 is brought into pressure contact (at contact point A) with the photoreceptor surface at the photoreceptor cylinder's center angle β within ±30 degrees.

The toner cleaning device is structured so that the cleaning blade 211 is attached to supporting member 212 (for which commonly, a metal plate is employed).

In the present invention, it is preferable that the edge of the cleaning blade, which is brought into pressure contact with the photoreceptor surface, is subjected to pressure contact in such a state that load is applied in the opposite direction (or counter direction) to the rotation direction of the photoreceptor. As illustrated in FIG. 19, it is preferable that the edge of the cleaning blade, when brought into pressure contacted with the photoreceptor, forms a pressure contact plane.

In the present invention, contact load P and contact angle θ of the cleaning blade to the photoreceptor are preferably from 5 to 40 N/m and from 5 to 35 degrees, respectively.

The contact load P is the vector value of pressure contact force P' in the normal direction when blade 211 is brought into contact with photoreceptor 10.

Further, the contact angle θ refers to the angle between tangential line X and the blade (in FIG. 19, shown using a dotted line) prior to deformation at the contact point with the photoreceptor.

Further, as shown in FIG. 19, free length L of the cleaning blade refers to the length between end B of supporting member 212 and the extreme end of the blade prior to deformation. The free length L is preferably from 6 to 15 mm. Thickness t of the cleaning blade is preferably from 0.5 to 10 mm, and thickness t of the cleaning blade, as described herein, refers to the thickness in the perpendicular direction with respect to the adhesion plane of supporting member 212, as shown in FIG. 19.

Flat conductive member 219, shown in FIG. 19, is provided on the side of frame body 218 of toner cleaning device 21 as well as on the upstream side (with respect to the rotation direction of the photoreceptor) of the cleaning blade, and the end of flat conductive member 219 comes into contact with the photoreceptor surface. Due to that, charge of the toner as well as the photoreceptor is eliminated. As a result, cleaning properties are improved. Further, excessive load is not applied to the cleaning blade. As a result, blade problems such as blade curl-under and blade noise are overcome.

Numeral 220 is a back-supporting member (such as a bent polyethylene terephthalate sheet), and numeral 221 is a toner guide (being a sheet such as a polyethylene terephthalate sheet). These members minimize scattering of removed toner to the exterior of the toner cleaning device. Further, in order to effectively eliminate charge of the toner or the photoreceptor, it is preferable that flat conductive member 219 be grounded.

In the toner cleaning device, cleaning blade 211 is attached to supporting member 212. Employed as materials of the cleaning blade are rubber elastic bodies, and known as the materials are urethane rubber, silicone rubber, fluorinated rubber, chloroprene rubber, and butadiene rubber. Of these, urethane rubber is particularly preferred, since its abrasion properties are superior to other rubbers. For example, the urethane rubber, described in Japanese Patent Publication Open to Public Inspection No. 59-30574, is preferred which is prepared by allowing polycaprolactone ester to react with polyisocyanate thereby hardening.

Alternatively, the supporting member 212 is comprised of plate-shaped metallic member or plastic member. Preferred as metallic members are stainless steel plates, aluminum plates, and damping steel plates.

It is characterized that one part of the cleaning blade and the supporting member are joined to each other in parallel. Joined in parallel, as described herein, means that the cleaning blade and supporting member are joined in parallel plane (stacked one above the other). Namely, as shown in FIGS. 20(*a*) through 20(*f*), it means that one part of the supporting member and the blade are stacked with each other in parallel and are joined in the parallel plane. On the other hand, as shown in FIG. 20(*g*), joining in series, as described herein, means that the supporting member and the blade are linearly joined.

FIGS. 20(*a*) through 20(*e*) show specific examples of effective adhesion of damping materials.

In FIGS. 20(*a*) through 20(*g*), "y" (the oblique lined area) represents the damping material, numeral 211 represents the cleaning blade, and numeral 212 represents the supporting material.

FIGS. 20(*a*) through 20(*e*) show examples of the present invention, while FIGS. 20(*f*) and 20(*g*) show examples beyond the present invention.

In FIGS. 20(*a*) through 20(*e*), portions of cleaning blade 211 and supporting member 212 are stacked in parallel and joined. On the other hand, FIG. 20(*f*) show the case in which no damping material is employed. In FIG. 20(*g*), cleaning blade 211 and supporting member 212 are joined in series.

FIG. 20(*a*) shows an example in which damping material y is adhered between the cleaning blade and the supporting member; FIG. 20(*b*) shows an example in which damping material y is adhered onto the cleaning blade; FIGS. 20(*c*) through 20(*e*) show examples in which damping material y is adhered onto the supporting material. By employing damping materials in the manner as above, as shown in the results of examples described below, FIGS. 20(*a*) through 20(*e*) exhibit excellent cleaning properties such as, minimizing insufficient residual toner removal as well as minimizing the formation of blade curl-under, compared to FIG. 20(*f*) which does not employ damping materials, and FIG. 20(*g*) in which cleaning blade 211 and supporting material 212 are joined in series.

$S_1/S_2$ is preferably in the range of 0.05 to 12, wherein $S_1$ is the adhered area (being one side area) of the damping material and $S_2$ is the cleaning blade area (being the product of the length "a" of the cleaning blade in the free length direction in FIG. 5 and length "b" of the photoreceptor in the axis direction). When $S_1/S_2$ is less than 0.05, the desired effects of the present invention are barely noted, while when it exceeds 12, the effects are barely increased. Further, $S_1/S_2$ is more preferably in the range of 0.3 to 5, and is most preferably in the range of 0.5 to 3.

Adhesion of the damping material onto the cleaning blade or the supporting member may be carried out employing double faced adhesive tapes or appropriate adhesives. However, when available damping materials are tape-type or sheet-type and can be adhered, they may be employed without any modification.

Example 6

Insufficient residual toner removal, blade curl-under, and vibration amplitude of the cleaning blade were evaluated employing a digital copier, being a modified Konica 7050 (having processes utilizing corona charging, laser exposure, reversal development, electrostatic transfer, claw separation, and the cleaning blade) manufactured by Konica Corp., having the upper toner cleaning device basically described in FIGS. 17 through 19, in which the joined state of the cleaning blade with the supporting member, the damping material adhesion position, the blade contact load, and the contact angle combinations (1A through 1G) were arranged as shown in Table 7. During the evaluation, an original document, having equal quarters of a text image at a pixel ratio of 7 percent, a gray scale image, a solid white image, and a solid black image, was continuously copied onto A4 paper sheets for 90 minutes at a rate of 50 A4 sheets/minute at normal temperature and normal humidity (24° C. and 60 percent relative humidity). However, prior to the beginning of the evaluation, in order that the cleaning blade became adjusted to the photoreceptor, cleaning powder was scattered onto the photoreceptor and the cleaning blade, and the photoreceptor was rotated for 1 minute.

Properties of the cleaning blade, the joint width of the cleaning blade with the supporting member, the photoreceptor, the developer cleaning conditions, evaluation conditions, and evaluation items, as well as evaluation criteria, were the same as those of Example 1.

Table 7 shows the evaluation results.

TABLE 7

| | 1A | 1B | 1C | 1D | 1E | 1F | 1G |
|---|---|---|---|---|---|---|---|
| Leading Edge Position of Cleaning Blade (cylinder center angle β in degrees) | 0 | 25 | 0 | 0 | −25 | 0 | 0 |
| Joining State of Cleaning Blade with Supporting Member | in parallel | in parallel | in parallel | in parallel | in parallel | in parallel | in series |
| Damping Material Adhesion Area | present FIG. 20 (a) | present FIG. 20 (b) | present FIG. 20 (c) | present FIG. 20 (d) | present FIG. 20 (e) | none FIG. 20 (f) | present FIG. 20 (g) |
| $S_1$ (in $mm^2$) | 7344 | 3060 | 1850 | 12240 | 30600 | 0 | 680 |
| $S_2$ (in $mm^2$) | 6120 | 6120 | 6120 | 6120 | 6120 | 6120 | 6120 |
| $S_1/S_2$ | 1.2 | 0.5 | 0.3 | 2 | 5 | 0 | 0.11 |
| Cleaning Blade Load (in N/m) | 20 | 30 | 10 | 30 | 20 | 20 | 20 |
| Cleaning Blade Contact Angle θ (in degrees) | 20 | 25 | 15 | 15 | 20 | 20 | 20 |
| Insufficient Residual Toner Removal | A | A | A | A | A | C | C |
| Blade Curl Under | A | A | A | A | A | C | C |
| Vibration Amplitude (in μm) | 120 | 150 | 170 | 170 | 150 | 250 | 220 |

As can clearly be seen from Table 7, combinations 1A through 1E within the present invention, in which the cleaning blade and the supporting member are joined in parallel and the damping material is adhered, exhibit excellent cleaning properties without insufficient residual toner removal as well as blade curl-under, while 1F and 1G beyond the present invention result in greater vibration amplitude than those within the present invention and result in insufficient residual toner removal as well as blade curl-under.

Example 7

Evaluation was carried out in the same manner as Example 6, except that conditions of the cleaning blade, the damping material, the photoreceptor, the developer, and the like were varied as described below.

Cleaning blade: hardness of 70 degrees, impact resilience of 50 percent, thickness of 2.5 mm, and free length of 5 mm.

Damping material: Scotch Damp SJ2015X-Type 112 (manufactured by Sumitomo 3M Limited) (having a maximum loss factor $\eta_{max}$ of approximately 1.0)

Photoreceptor: P2

Developer: 2 (Toner: T2)

Other cleaning conditions are:

Cleaning blade contact angle: described in Table 3

Cleaning blade load (in N/m): described in Table 3

Other conditions were same as Example 6.

Table 8 shows the results.

TABLE 8

| | 2A | 2B | 2C | 2D | 2E | 2F | 2G |
|---|---|---|---|---|---|---|---|
| Leading Edge Position of Cleaning Blade (cylinder center angle β in degrees) | 0 | 25 | 0 | 0 | −25 | 0 | 0 |
| Joining State of Cleaning Blade with Supporting Member | in parallel | in parallel | in parallel | in parallel | in parallel | in parallel | in series |
| Damping Material | present | present | present | present | present | none | present |
| Adhesion Area | FIG. 20 (a) | FIG. 20 (b) | FIG. 20 (c) | FIG. 20 (d) | FIG. 20 (e) | FIG. 20 (f) | FIG. 20 (g) |
| $S_1$ (in $mm^2$) | 7344 | 3060 | 1850 | 12240 | 30600 | 0 | 680 |
| $S_2$ (in $mm^2$) | 6120 | 6120 | 6120 | 6120 | 6120 | 6120 | 6120 |
| $S_1/S_2$ | 1.2 | 0.5 | 0.3 | 2 | 5 | 0 | 0.11 |
| Cleaning Blade Load (in N/m) | 20 | 30 | 10 | 30 | 20 | 20 | 20 |
| Cleaning Blade Contact Angle θ (in degrees) | 20 | 25 | 15 | 15 | 20 | 20 | 20 |
| Insufficient Residual Toner Removal | A | A | A | A | A | C | C |
| Blade Curl-Under | A | A | A | A | A | C | B |
| Vibration Amplitude (in μm) | 130 | 160 | 180 | 180 | 160 | 250 | 230 |

As can clearly be seen from Table 8, combinations 2A through 2E within the present invention, in which the cleaning blade and the supporting member are joined in parallel and the damping material is adhered, exhibit excellent cleaning properties without insufficient residual toner removal as well as blade curl-under, while 2F and 2G beyond the present invention result in greater vibration amplitude than those of the present invention and result in insufficient residual toner removal as well as blade curl-under.

Example 8

Evaluation was carried out under the same conditions as Example 6, except that the photoreceptor and the developer were replaced with those described below, the type of the damping material was varied as shown in Table 9, and combinations (3A through 3C) of the damping material adhesion position, the blade contact load and the contact angle were set as shown in Table 9. Table 9 shows the evaluation results.

Photoreceptor: P2

Developer: 2 (Toner: T2)

TABLE 9

| | 3A | 3B | 3C |
|---|---|---|---|
| Leading Edge Position of Cleaning Blade (cylinder center angle β in degrees) | 0 | 25 | 0 |
| Joining State of Cleaning Blade with Supporting Member | in parallel | in parallel | in parallel |
| Damping Material | present | present | present |
| Adhesion Area | FIG. 20 (a) | FIG. 20 (a) | FIG. 20 (a) |
| Type of Damping Material | LR-A, manufactured by Bridgestone Corp. | VEM113, manufactured by Sumitomo 3M Limited | LR-V, manufactured by Bridgestone Corp. |
| $S_1$ (in $mm^2$) | 7344 | 7344 | 7344 |
| $S_2$ (in $mm^2$) | 6120 | 6120 | 6120 |
| $S_1/S_2$ | 1.2 | 1.2 | 1.2 |
| Cleaning Blade Load (in N/m) | 20 | 20 | 20 |
| Cleaning Blade Contact Angle θ (in degrees) | 15 | 15 | 20 |
| Insufficient Residual Toner Removal | A | A | A |
| Blade Curl-Under | A | A | A |
| Vibration Amplitude (in μm) | 130 | 130 | 140 |

As can clearly be seen from Table 9, combinations 3A through 3C within the present invention, in which the cleaning blade and the supporting member are joined in parallel and the damping material is adhered, exhibit excellent cleaning properties without insufficient residual toner removal as well as blade curl-under.

Example 9

Evaluation was carried out under the same conditions as 1A of Example 6, except that the viscoelastic properties of damping materials were varied as described in Table 10. Table 10 shows the evaluation results.

TABLE 10

| | 4A | 4B | 4C | 4D | 4E |
|---|---|---|---|---|---|
| Leading Edge Position of Cleaning Blade (cylinder center angle β in degrees) | 0 | 0 | 0 | 0 | 0 |
| Joined State of Cleaning Blade with Supporting Member | in parallel | in parallel | in parellel | in parellel | in parellel |
| Damping Material | present | present | present | present | present |
| Adhesion Area | FIG. 20 (a) | FIG. 20 (a) | FIG. 20 (a) | FIG. 20 (a) | FIG. 20 (a) |

TABLE 10-continued

| | 4A | 4B | 4C | 4D | 4E |
|---|---|---|---|---|---|
| Maximum Loss Factor $\eta_{max}$ of Damping Material | 0.3 | 0.5 | 1 | 1.5 | 2 |
| Dynamic Shearing Elasticity Modulus $G^1$ (in kPa) at $\eta_{max}$ | $6.9 \times 10^4$ | $1.38 \times 10^4$ | $6.9 \times 10^3$ | $4.83 \times 10^3$ | $3.45 \times 10^3$ |
| Cleaning Blade Load (in N/m) | 20 | 30 | 10 | 30 | 20 |
| Cleaning Blade Contact Angle θ (in degrees) | 20 | 25 | 15 | 15 | 20 |
| Insufficient residual toner removal | B | A | A | A | A |
| Blade Curl-under | A | A | A | A | A |
| Vibration Amplitude (in μm) | 200 | 180 | 130 | 150 | 190 |

As can clearly be seen from Table 10, samples having a maximum loss factor $\eta_{max}$ of the damping material in the range of 0.3 to 2.0 exhibit excellent cleaning properties without insufficient residual toner removal and blade curl-under and also result in large damping effects for vibration amplitude, and the damping materials, having a maximum loss factor $\eta_{max}$ in the range of 0.5 to 1.5, greatly exhibit the desired effects.

Example 10

Evaluation was carried out in the same manner as Example 6, except that damping material adhesion area $S_1$ and cleaning blade area $S_2$ were varied to a greater extent. Table 11 shows the evaluating results.

TABLE 11

| | 5A | 5B | 5C | 5D | 5E |
|---|---|---|---|---|---|
| Leading Edge Position of Cleaning Blade (cylinder center angle β in degrees) | 0 | 0 | 0 | 0 | 0 |
| Joined State of Cleaning Blade with Supporting Member | in parellel | in parellel | in parellel | in parellel | in parallel |
| Damping Material | present | present | present | present | present |
| Adhesion Area | FIG. 20 (b) | FIG. 20 (b) | FIG. 20 (b) | FIG. 20 (e) | FIG. 20 (e) |
| $S_1$ (in $mm^2$) | 306 | 1850 | 3060 | 30600 | 73440 |
| $S_2$ (in $mm^2$) | 6120 | 6120 | 6120 | 6120 | 6120 |
| $S_1/S_2$ | 0.05 | 0.3 | 0.5 | 5 | 12 |
| Cleaning Blade Load (in N/m) | 20 | 20 | 20 | 20 | 20 |
| Cleaning Blade Contact Angle θ (in degrees) | 20 | 20 | 20 | 20 | 20 |
| Insufficient Residual Toner Removal | B | A | A | A | A |
| Blade Curl-Under | B | A | A | A | A |
| Vibration Amplitude (in μm) | 200 | 150 | 120 | 150 | 150 |

As can clearly be seen from Table 11, the entire range of ratio $S^1/S_2$ from 0.05 to 12 exhibits the desired effects, and the range of 0.3 to 5 greatly exhibits the desired effects.

As can clearly be seen from the examples above, by employing the toner cleaning device of the present invention, it is possible to effectively remove the residual toner on the organic photoreceptor without blade curl-under, as well as insufficient residual toner removal.

What is claimed is:

1. A toner cleaning device for removing toner which remains on an organic photoreceptor after developing an electrostatic latent image formed on the organic photoreceptor with a developer containing toner and transferring a toner image formed by the developing on the photoreceptor to a transfer material, the toner cleaning device comprising:

(a) a cleaning blade;

(b) a supporting member of the cleaning blade; and (c) a damping material, wherein the cleaning blade and the supporting member are partially joined in parallel to each other, and the damping material is adhered onto either the cleaning blade or the supporting member, and wherein the damping material is a viscoelastic material having a maximum loss factor $\eta_{max}$ of 0.3 to 2.0.

2. A toner cleaning device for removing toner which remains on an organic photoreceptor after developing an electrostatic latent image formed on the organic photoreceptor with a developer containing toner and transferring a toner image formed by the developing on the photoreceptor to a transfer material, the toner cleaning device comprising:

(a) a cleaning blade;

(b) a supporting member of the cleaning blade; and (c) a damping material, wherein the cleaning blade and the supporting member are partially joined in parallel to each other, and the damping material is adhered onto either the cleaning blade or the supporting member, and wherein $S_1/S_2$ is in the range of 0.05 to 12, where $S_1$ represents a damping material adhesion area and $S_2$ represents an area of the cleaning blade.

3. A toner cleaning device for removing toner which remains on an organic photoreceptor after developing an electrostatic latent image formed on the organic photoreceptor with a developer containing toner and transferring a toner image formed by the developing on the photoreceptor to a transfer material, the toner cleaning device comprising:

(a) a cleaning blade;

(b) a supporting member of the cleaning blade; and (c) a damping material, wherein the cleaning blade and the supporting member are partially joined in parallel to each other, and the damping material is adhered onto either the cleaning blade or the supporting member, wherein a leading edge of the cleaning blade comes into pressure contact with the organic photoreceptor whose shape is cylindrical, within a cylinder center angle of $\beta\pm30$ degrees when measured from a top point in a vertical direction of the cylindrical organic photoreceptor, and wherein the damping material is a viscoelastic material having a maximum loss factor $\eta_{max}$ of 0.3 to 2.0.

4. A toner cleaning device for removing toner which remains on an organic photoreceptor after developing an electrostatic latent image formed on the organic photoreceptor with a developer containing toner and transferring a toner image formed by the developing on the photoreceptor to a transfer material, the toner cleaning device comprising:

(a) a cleaning blade;

(b) a supporting member of the cleaning blade; and (c) a damping material, wherein the cleaning blade and the supporting member are partially joined in parallel to each other, and the damping material is adhered onto either the cleaning blade or the supporting member, wherein a leading edge of the cleaning blade comes into pressure contact with the organic photoreceptor whose shape is cylindrical, within a cylinder center angle of $\beta\pm30$ degrees when measured from a top point in a vertical direction of the cylindrical organic photoreceptor, and wherein $S_1/S_2$ is in the range of 0.05 to 12, where $S_1$ represents a damping material adhesion area and $S_2$ represents an area of the cleaning blade.

5. An image forming method comprising the steps of:

(a) developing an electrostatic latent image formed on an organic photoreceptor with a developer containing a toner;

(b) transferring a toner image formed by the developing on the photoreceptor onto a transfer material; and (c) then removing toner which remains on the organic photoconductor employing a toner cleaning device comprising a cleaning blade, a supporting member of the cleaning blade, and a damping material, wherein the cleaning blade and the supporting member are partially joined in parallel to each other, and the damping material is adhered onto either the cleaning blade or the supporting member, wherein a leading edge of the cleaning blade comes into pressure contact with the organic photoreceptor whose shape is cylindrical, within a cylinder center angle of $\beta\pm30$ degrees when measured from a top point in a vertical direction of the cylindrical organic photoreceptor, and wherein employed as the toner used for the development means is one which contains toner particles without corners in a ratio of at least 65 percent by number.

6. The image forming method of claim 5, wherein as the toner, a toner having a variation coefficient, of the shape coefficient of toner particles, of no more than 16 percent and a number variation coefficient in the number particle size distribution of the toner particles of no more than 27 percent is employed.

7. The imagine forming method of claim 5, wherein as the toner, employed is a toner containing toner particles having a shape coefficient in the range of 1.2. to 1.6 in a ratio of at least 65 percent by number.

8. The image forming method of claim 5, wherein as the toner, employed is a toner containing toner particles without corners in a ratio of 50 percent by number.

9. The image forming method of claim 5, wherein the damping material is a viscoelastic material having a maximum loss factor $\eta_{max}$ of 0.3 to 2.0.

10. The image forming method of claim 5, wherein $S_1/S_2$ is in the range of 0.05 to 12 where $S_1$ represents a damping material adhesion area and $S_2$ represents an area of the cleaning blade.

* * * * *